US011361621B2

(12) United States Patent
Sanborn et al.

(10) Patent No.: US 11,361,621 B2
(45) Date of Patent: Jun. 14, 2022

(54) ACTIVE MYSTERY FEATURE

(71) Applicant: Aristocrat Technologies, Inc., Las Vegas, NV (US)

(72) Inventors: Hanna Sanborn, Georgetown, TX (US); Rogelio Decasa, Jr., Renton, WA (US); Jeffrey Uss, Liberty Hill, TX (US); Chad La Guardia, Austin, TX (US); Jennifer Mizzi, Reno, NV (US); Erick Ching, Cedar Park, TX (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 224 days.

(21) Appl. No.: 16/810,382

(22) Filed: Mar. 5, 2020

(65) Prior Publication Data

US 2021/0280012 A1 Sep. 9, 2021

(51) Int. Cl.
*G07F 17/32* (2006.01)

(52) U.S. Cl.
CPC ..... *G07F 17/3262* (2013.01); *G07F 17/3213* (2013.01); *G07F 17/3267* (2013.01)

(58) Field of Classification Search
CPC ..... G07F 17/3262; G07F 17/3213; G07F 17/3267
See application file for complete search history.

(56) References Cited

U.S. PATENT DOCUMENTS

| | | | | |
|---|---|---|---|---|
| 7,857,698 | B2 | 12/2010 | Hein et al. | |
| 8,177,620 | B2 | 5/2012 | Miles et al. | |
| 8,506,390 | B2 * | 8/2013 | Vann | G07F 17/3244 463/26 |
| 9,064,368 | B2 | 6/2015 | Englman et al. | |
| 9,082,261 | B2 | 7/2015 | Caputo et al. | |
| 10,636,252 | B2 * | 4/2020 | Meyer | G07F 17/3267 |
| 2002/0151341 | A1 | 10/2002 | Baerlocher et al. | |
| 2003/0064794 | A1 | 4/2003 | Mead et al. | |
| 2004/0005919 | A1 | 1/2004 | Walker et al. | |
| 2004/0053680 | A1 | 3/2004 | Schultz | |
| 2005/0101368 | A1 | 5/2005 | Thomas | |
| 2006/0194633 | A1 | 8/2006 | Paulsen | |
| 2006/0229124 | A1 | 10/2006 | Walker et al. | |
| 2007/0010308 | A1 | 1/2007 | Duhamel | |
| 2008/0076514 | A1 | 3/2008 | Baerlocher et al. | |
| 2009/0275385 | A1 | 11/2009 | Yadav | |

(Continued)

FOREIGN PATENT DOCUMENTS

AU 2019/253906 11/2019

*Primary Examiner* — David L Lewis
*Assistant Examiner* — Shauna-Kay Hall
(74) *Attorney, Agent, or Firm* — Weaver Austin Villeneuve & Sampson LLP

(57) ABSTRACT

Game features for at least a base slot game may be selectable according to player input. According to some examples, game features may be selectable without exiting from a graphical user interface used to present the slot game. A first GUI portion may be presented in a first area of a display system. The first GUI portion may include display symbols for presenting the slot game. A second GUI portion may be presented in a second area of the display system while the first GUI portion is being presented in the first area, e.g., while the slot game is being presented in the first area. The second GUI portion may include multiple game feature images. Each game feature image may correspond with a selectable game feature.

23 Claims, 20 Drawing Sheets

(56) References Cited

U.S. PATENT DOCUMENTS

| | | | | |
|---|---|---|---|---|
| 2013/0244761 | A1* | 9/2013 | Agarwal | G07F 17/3244 463/25 |
| 2014/0128151 | A1 | 5/2014 | Pau et al. | |
| 2014/0329590 | A1 | 11/2014 | Caputo et al. | |
| 2014/0357342 | A1* | 12/2014 | Elias | G07F 17/32 463/20 |
| 2015/0356829 | A1 | 12/2015 | Caputo et al. | |
| 2017/0301185 | A1 | 10/2017 | Bryant et al. | |
| 2019/0164382 | A1* | 5/2019 | Maddux | G07F 17/3293 |
| 2019/0392675 | A1* | 12/2019 | Humphrey | G07F 17/34 |

* cited by examiner

ACTIVE MYSTERY FEATURE

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

SUMMARY

One innovative aspect of the subject matter described in this disclosure may be implemented in an apparatus. The apparatus may include an interface system, a display system and a control system. In some examples, the apparatus may be a gaming device. The interface system may, in some instances, include at least one network interface and at least one user interface.

The control system may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. According to some examples, the control system may be configured for controlling the display system to present a graphical user interface (GUI) for presenting a wagering game. The wagering game may, in some examples, be a slot game.

Presenting the GUI may involve presenting a first GUI portion in a first area of the display system. The first GUI portion may include display symbols presented at a plurality of display symbol locations. The plurality of display symbol locations may, for example, be arranged in a plurality of display symbol rows and display symbol columns. Presenting the GUI may involve presenting a second GUI portion in a second area of the display system while the first GUI portion is being presented in the first area of the display system. The second GUI portion may include a plurality of game feature images, each game feature image of the plurality of game feature images corresponding with one of a plurality of selectable game features.

According to some examples, the control system may be configured for receiving, via the interface system, first game feature input for selecting a game feature corresponding to one of the game feature images. In some examples, the control system may be configured for receiving, via the interface system, first base game initiation input for initiation of a first base game instance of the wagering game and for controlling the display system to present the first base game instance of the wagering game in the first GUI portion while continuing to present the second GUI portion in the second area of the display system.

In some instances, presenting the first base game instance of the wagering game may involve determining a first base game outcome and corresponding first display symbols for the first base game instance of the wagering game and controlling the display system to display the first base game outcome in the first GUI portion. According to some examples, receiving the first game feature input may involve receiving user input for selecting a first game feature. In some such examples, determining the first base game outcome may involve determining whether to remove at least one display symbol from a full set of display symbols that may be potentially available for selection during the instance of the wagering game. The full set of display symbols may, in some instances, include lower-value display symbols and higher-value display symbols. In some implementations, at least one display symbol may be a lower-value display symbol. According to some examples, determining whether to remove the at least one display symbol may involve determining whether to remove all of the lower-value display symbols.

In some examples, determining whether to remove the at least one display symbol may involve making at least one random number generator (RNG) call and receiving a result of the at least one RNG call. Some such examples may involve determining whether to remove at least one display symbol by applying the result of the at least one RNG call to at least one weighted table corresponding to the first game feature.

According to some implementations, receiving the first game feature input may involve receiving user input for selecting a second game feature. Determining the first base game outcome may involve determining whether to present wild symbols in at least an entire display symbol row or at least an entire display symbol column. In some such examples, determining the first base game outcome may involve determining whether to present wild symbols in one entire display symbol column, two entire display symbol columns, three entire display symbol columns or four entire display symbol columns.

In some examples, receiving the first game feature input may involve receiving user input for selecting a third game feature. In some such examples, determining the first base game outcome may involve determining whether to remove all instances of at least a first display symbol from a full set of display symbols that may be potentially available for selection during the instance of the wagering game. Some such implementations may involve determining whether to substitute a second display symbol for all instances of at least the first display symbol. In some instances, determining the first base game outcome may involve determining whether to remove all instances of all picture-type display symbols from the full set of display symbols.

In some instances, determining the first base game outcome may involve making at least a first random number generator (RNG) call and a second RNG call and receiving a first result of the first RNG call and a second result of the second RNG call. Some such examples may involve determining, by applying the first result to a first weighted table corresponding to the third game feature, that all instances of at least the first display symbol will be removed from the full set of display symbols. Some such examples may involve determining, by applying the second result to a second weighted table corresponding to the third game feature, the second display symbol.

According to some implementations, determining the first base game outcome may involve determining that the first base game outcome will trigger a free game round. In some such examples, each free game instance of the free game round may involve randomly selecting, via the control system, a game feature from the plurality of selectable game features. Some such examples may involve determining, via the control system, a free game outcome based, at least in part, on the game feature.

In some examples, randomly selecting the game feature may involve making at least one random number generator (RNG) call and receiving a result of the at least one RNG call. Some such examples may involve selecting the game feature by applying the result of the at least one RNG call to at least one weighted table corresponding to the plurality of selectable game features. In some such examples, the at least one weighted table may make a selected game feature more likely to be different from a most recent game feature than to be the most recent game feature.

In some instances, determining the first base game outcome may involve determining that the first base game outcome will trigger a free game round. According to some such examples, the control system may be further configured for controlling the display system to present at least one free game feature image in the second GUI portion. The free game feature image may, in some examples, correspond to a free game feature that is not selectable for a base game. The free game feature may, in some examples, be available for at least a first free game instance of the free game round. In some instances, the free game feature may be selectable via input received via the interface system. According to some examples, each free game instance of the free game round may involve randomly selecting, via the control system, a game feature and determining, via the control system, a free game outcome that is based at least in part on the game feature. In some implementations, the control system may be further configured to automatically select the free game feature for at least the first free game instance.

According to some examples, the control system may be further configured for receiving, via the interface system, second game feature input for selecting a game feature corresponding to one of the game feature images presented in the second GUI portion and for receiving, via the interface system, second base game initiation input for initiation of a second base game instance of the wagering game. In some such examples, the control system may be further configured for presenting the second base game instance of the wagering game in the first GUI portion while continuing to present the second GUI portion in the second area of the display system.

In some instances, the control system may be further configured for controlling the display system to move a game feature image corresponding to a selected game feature to a predetermined location. In some examples, the predetermined location may be a central portion of the second area of the display system.

Still other innovative aspects of the subject matter described in this disclosure can be implemented in a gaming method. In some examples, the method may involve controlling (e.g., via a control system) a display system of a gaming device to present a graphical user interface (GUI) for presenting a wagering game. The wagering game may, in some examples, be a slot game.

Presenting the GUI may involve presenting a first GUI portion in a first area of the display system. The first GUI portion may include display symbols presented at a plurality of display symbol locations. The plurality of display symbol locations may, for example, be arranged in a plurality of display symbol rows and display symbol columns. Presenting the GUI may involve presenting a second GUI portion in a second area of the display system while the first GUI portion is being presented in the first area of the display system. The second GUI portion may include a plurality of game feature images, each game feature image of the plurality of game feature images corresponding with one of a plurality of selectable game features.

According to some examples, the method may involve receiving, via an interface system of the gaming device, first game feature input for selecting a game feature corresponding to one of the game feature images. In some examples, the method may involve receiving, via the interface system, first base game initiation input for initiation of a first base game instance of the wagering game and for controlling the display system to present the first base game instance of the wagering game in the first GUI portion while continuing to present the second GUI portion in the second area of the display system.

In some instances, presenting the first base game instance of the wagering game may involve determining a first base game outcome and corresponding first display symbols for the first base game instance of the wagering game and controlling the display system to display the first base game outcome in the first GUI portion. According to some examples, receiving the first game feature input may involve receiving user input for selecting a first game feature. In some such examples, determining the first base game outcome may involve determining whether to remove at least one display symbol from a full set of display symbols that may be potentially available for selection during the instance of the wagering game. The full set of display symbols may, in some instances, include lower-value display symbols and higher-value display symbols. In some implementations, at least one display symbol may be a lower-value display symbol. According to some examples, determining whether to remove the at least one display symbol may involve determining whether to remove all of the lower-value display symbols.

In some examples, determining whether to remove the at least one display symbol may involve making at least one random number generator (RNG) call and receiving a result of the at least one RNG call. Some such examples may involve determining whether to remove at least one display symbol by applying the result of the at least one RNG call to at least one weighted table corresponding to the first game feature.

According to some implementations, receiving the first game feature input may involve receiving user input for selecting a second game feature. Determining the first base game outcome may involve determining whether to present wild symbols in at least an entire display symbol row or at least an entire display symbol column. In some such examples, determining the first base game outcome may involve determining whether to present wild symbols in one entire display symbol column, two entire display symbol columns, three entire display symbol columns or four entire display symbol columns.

In some examples, receiving the first game feature input may involve receiving user input for selecting a third game feature. In some such examples, determining the first base game outcome may involve determining whether to remove all instances of at least a first display symbol from a full set of display symbols that may be potentially available for selection during the instance of the wagering game. Some such implementations may involve determining whether to substitute a second display symbol for all instances of at least the first display symbol. In some instances, determining the first base game outcome may involve determining whether to remove all instances of all picture-type display symbols from the full set of display symbols.

In some instances, determining the first base game outcome may involve making at least a first random number generator (RNG) call and a second RNG call and receiving a first result of the first RNG call and a second result of the second RNG call. Some such examples may involve determining, by applying the first result to a first weighted table corresponding to the third game feature, that all instances of at least the first display symbol will be removed from the full set of display symbols. Some such examples may involve determining, by applying the second result to a second weighted table corresponding to the third game feature, the second display symbol.

According to some implementations, determining the first base game outcome may involve determining that the first base game outcome will trigger a free game round. In some such examples, each free game instance of the free game round may involve randomly selecting, via the control system, a game feature from the plurality of selectable game features. Some such examples may involve determining, via the control system, a free game outcome based, at least in part, on the game feature.

In some examples, randomly selecting the game feature may involve making at least one random number generator (RNG) call and receiving a result of the at least one RNG call. Some such examples may involve selecting the game feature by applying the result of the at least one RNG call to at least one weighted table corresponding to the plurality of selectable game features. In some such examples, the at least one weighted table may make a selected game feature more likely to be different from a most recent game feature than to be the most recent game feature.

In some instances, determining the first base game outcome may involve determining that the first base game outcome will trigger a free game round. According to some such examples, the method may involve controlling the display system to present at least one free game feature image in the second GUI portion. The free game feature image may, in some examples, correspond to a free game feature that is not selectable for a base game. The free game feature may, in some examples, be available for at least a first free game instance of the free game round. In some instances, the free game feature may be selectable via input received via the interface system. According to some examples, each free game instance of the free game round may involve randomly selecting, via the control system, a game feature and determining, via the control system, a free game outcome that is based at least in part on the game feature. In some implementations, the control system may be further configured to automatically select the free game feature for at least the first free game instance.

According to some examples, the method may involve receiving, via the interface system, second game feature input for selecting a game feature corresponding to one of the game feature images presented in the second GUI portion and for receiving, via the interface system, second base game initiation input for initiation of a second base game instance of the wagering game. In some such examples, the method may involve presenting the second base game instance of the wagering game in the first GUI portion while continuing to present the second GUI portion in the second area of the display system.

In some instances, the method may involve controlling the display system to move a game feature image corresponding to a selected game feature to a predetermined location. In some examples, the predetermined location may be a central portion of the second area of the display system.

Some or all of the operations, functions and/or methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, some innovative aspects of the subject matter described in this disclosure can be implemented in one or more non-transitory media having software stored thereon.

For example, the software may include instructions for controlling one or more devices to perform a gaming method. In some examples, the method may involve controlling (e.g., via a control system) a display system of a gaming device to present a graphical user interface (GUI) for presenting a wagering game. The wagering game may, in some examples, be a slot game.

Presenting the GUI may involve presenting a first GUI portion in a first area of the display system. The first GUI portion may include display symbols presented at a plurality of display symbol locations. The plurality of display symbol locations may, for example, be arranged in a plurality of display symbol rows and display symbol columns. Presenting the GUI may involve presenting a second GUI portion in a second area of the display system while the first GUI portion is being presented in the first area of the display system. The second GUI portion may include a plurality of game feature images, each game feature image of the plurality of game feature images corresponding with one of a plurality of selectable game features.

According to some examples, the method may involve receiving, via an interface system of the gaming device, first game feature input for selecting a game feature corresponding to one of the game feature images. In some examples, the method may involve receiving, via the interface system, first base game initiation input for initiation of a first base game instance of the wagering game and for controlling the display system to present the first base game instance of the wagering game in the first GUI portion while continuing to present the second GUI portion in the second area of the display system.

In some instances, presenting the first base game instance of the wagering game may involve determining a first base game outcome and corresponding first display symbols for the first base game instance of the wagering game and controlling the display system to display the first base game outcome in the first GUI portion. According to some examples, receiving the first game feature input may involve receiving user input for selecting a first game feature. In some such examples, determining the first base game outcome may involve determining whether to remove at least one display symbol from a full set of display symbols that may be potentially available for selection during the instance of the wagering game. The full set of display symbols may, in some instances, include lower-value display symbols and higher-value display symbols. In some implementations, at least one display symbol may be a lower-value display symbol. According to some examples, determining whether to remove the at least one display symbol may involve determining whether to remove all of the lower-value display symbols.

In some examples, determining whether to remove the at least one display symbol may involve making at least one random number generator (RNG) call and receiving a result of the at least one RNG call. Some such examples may involve determining whether to remove at least one display symbol by applying the result of the at least one RNG call to at least one weighted table corresponding to the first game feature.

According to some implementations, receiving the first game feature input may involve receiving user input for selecting a second game feature. Determining the first base game outcome may involve determining whether to present wild symbols in at least an entire display symbol row or at least an entire display symbol column. In some such examples, determining the first base game outcome may involve determining whether to present wild symbols in one entire display symbol column, two entire display symbol columns, three entire display symbol columns or four entire display symbol columns.

In some examples, receiving the first game feature input may involve receiving user input for selecting a third game feature. In some such examples, determining the first base game outcome may involve determining whether to remove all instances of at least a first display symbol from a full set of display symbols that may be potentially available for selection during the instance of the wagering game. Some such implementations may involve determining whether to substitute a second display symbol for all instances of at least the first display symbol. In some instances, determining the first base game outcome may involve determining whether to remove all instances of all picture-type display symbols from the full set of display symbols.

In some instances, determining the first base game outcome may involve making at least a first random number generator (RNG) call and a second RNG call and receiving a first result of the first RNG call and a second result of the second RNG call. Some such examples may involve determining, by applying the first result to a first weighted table corresponding to the third game feature, that all instances of at least the first display symbol will be removed from the full set of display symbols. Some such examples may involve determining, by applying the second result to a second weighted table corresponding to the third game feature, the second display symbol.

According to some implementations, determining the first base game outcome may involve determining that the first base game outcome will trigger a free game round. In some such examples, each free game instance of the free game round may involve randomly selecting, via the control system, a game feature from the plurality of selectable game features. Some such examples may involve determining, via the control system, a free game outcome based, at least in part, on the game feature.

In some examples, randomly selecting the game feature may involve making at least one random number generator (RNG) call and receiving a result of the at least one RNG call. Some such examples may involve selecting the game feature by applying the result of the at least one RNG call to at least one weighted table corresponding to the plurality of selectable game features. In some such examples, the at least one weighted table may make a selected game feature more likely to be different from a most recent game feature than to be the most recent game feature.

In some instances, determining the first base game outcome may involve determining that the first base game outcome will trigger a free game round. According to some such examples, the method may involve controlling the display system to present at least one free game feature image in the second GUI portion. The free game feature image may, in some examples, correspond to a free game feature that is not selectable for a base game. The free game feature may, in some examples, be available for at least a first free game instance of the free game round. In some instances, the free game feature may be selectable via input received via the interface system. According to some examples, each free game instance of the free game round may involve randomly selecting, via the control system, a game feature and determining, via the control system, a free game outcome that is based at least in part on the game feature. In some implementations, the control system may be further configured to automatically select the free game feature for at least the first free game instance.

According to some examples, the method may involve receiving, via the interface system, second game feature input for selecting a game feature corresponding to one of the game feature images presented in the second GUI portion and for receiving, via the interface system, second base game initiation input for initiation of a second base game instance of the wagering game. In some such examples, the method may involve presenting the second base game instance of the wagering game in the first GUI portion while continuing to present the second GUI portion in the second area of the display system.

In some instances, the method may involve controlling the display system to move a game feature image corresponding to a selected game feature to a predetermined location. In some examples, the predetermined location may be a central portion of the second area of the display system.

Figure 1:
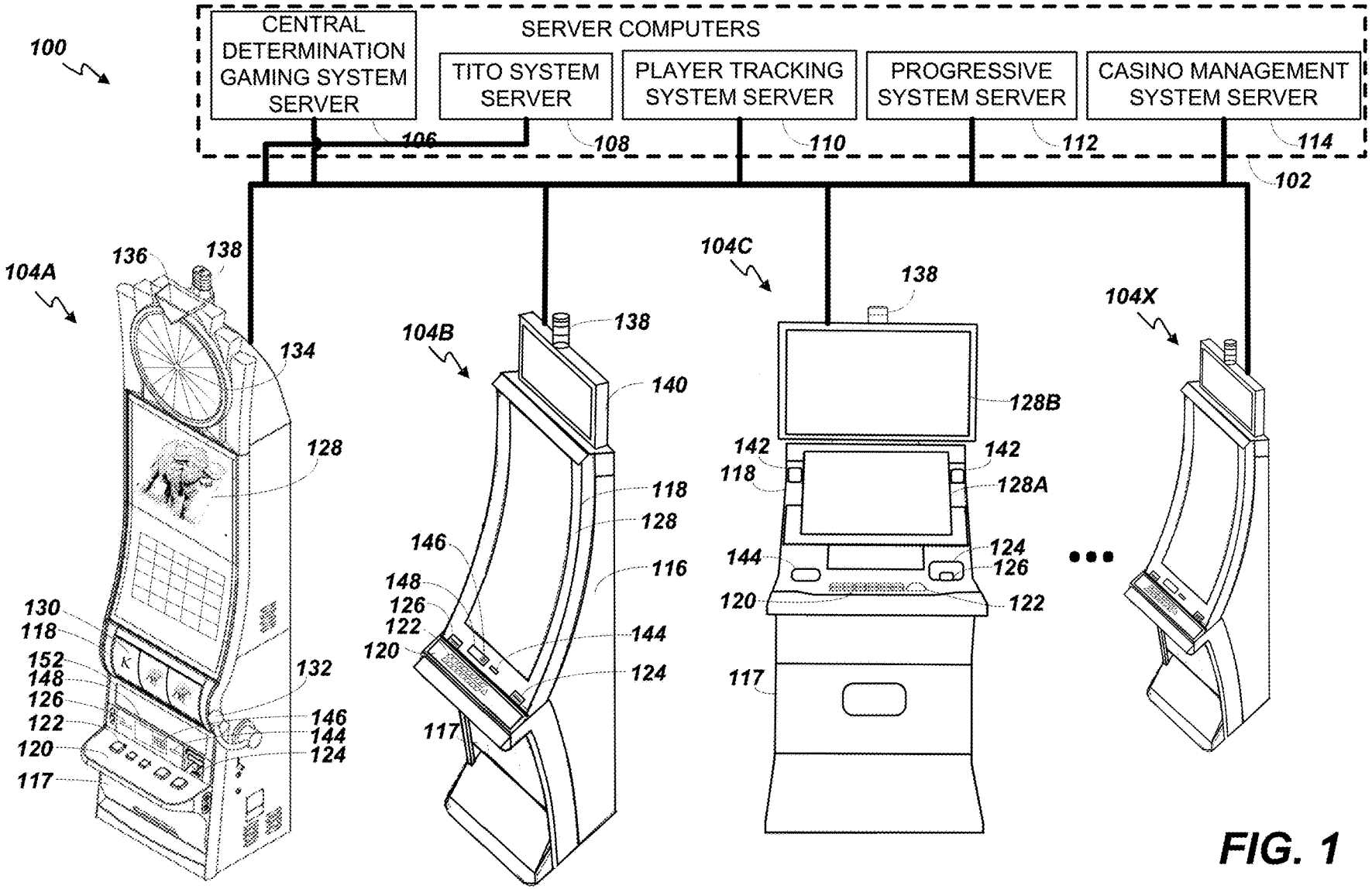
FIG. 1 is an example diagram showing several EGMs networked with various gaming-related servers.

The foregoing summary, as well as the following detailed description of certain embodiments of the present disclosure, will be better understood when read in conjunction with the appended drawings. For the purpose of illustrating the disclosure, certain embodiments are shown in the drawings. It should be understood, however, that the present disclosure is not limited to the arrangements and instrumentality shown in the attached drawings.

DETAILED DESCRIPTION

Some implementations may involve providing a slot game in which game features for at least a base game are selectable according to player input. In some examples, game features may be selectable according to detected input corresponding to a selection of a particular game feature image from among multiple game feature images. According to some examples, game features may be selectable without exiting from a graphical user interface used to present the slot game. For example, a control system may be configured for controlling a display system to present a first GUI portion in a first area of the display system. The first GUI portion may include display symbols for presenting the slot game, e.g., display symbols arranged in display symbol rows and display symbol columns. The control system may be configured for controlling the display system to present a second GUI portion in a second area of the display system while the first GUI portion is being presented in the first area, e.g., while the slot game is being presented in the first area. The second GUI portion may include multiple game feature images. Each game feature image may correspond with one of the selectable game features.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (Wi-Fi®) and Bluetooth®), cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 154 which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming machine 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2A:
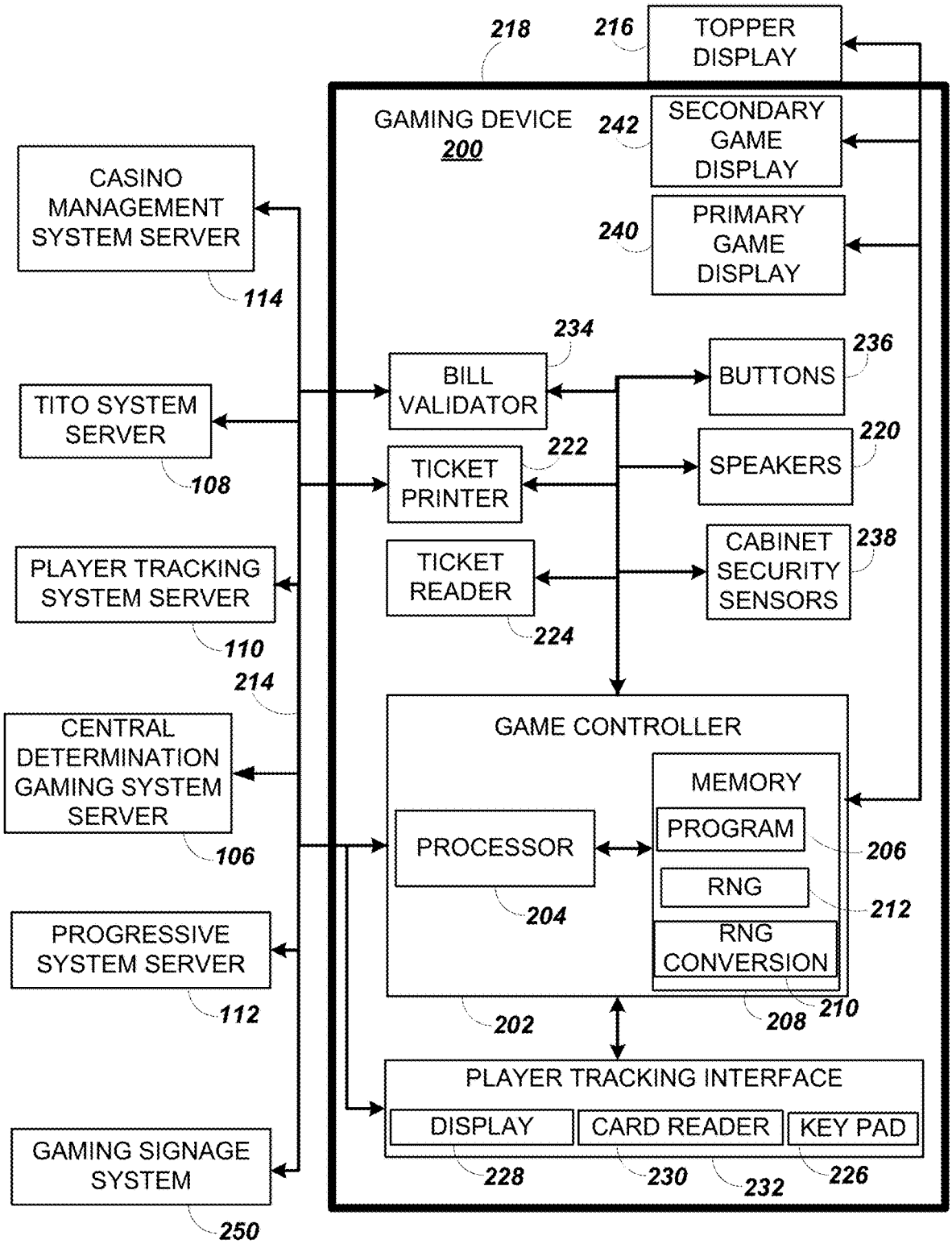
FIG. 2A is a block diagram showing various functional elements of an example EGM.

Many or all the above described components can be controlled by circuitry (e.g., a gaming controller) housed inside the main cabinet 116 of the gaming device 104A, the details of which are shown in FIG. 2A.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 154 which opens to provide access to the interior of the gaming device 104B. The main or service door 154 is typically used by service personnel to refill the ticket-out printer 126 and collect bills and tickets inserted into the bill validator 124. The main or service door 154 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2A is a block diagram depicting examples of internal electronic components of a gaming device 200 connected to various external systems. All or parts of the example gaming device 200 shown could be used to implement any one of the example gaming devices 104A-X depicted in FIG. 1. As shown in FIG. 2A, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2A also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2A illustrates that game controller 202 includes a single processor 204, game controller 202 is not limited to this representation and instead can include multiple processors 204 (e.g., two or more processors).

FIG. 2A illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2A illustrates that game controller 202 includes a single memory 208, game controller 208 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be setup to generate one or more game instances based on instructions and/or data that gaming device 200 exchange with one or more remote gaming devices, such as a central determination gaming system server 106 (not shown in FIG. 2A but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2A illustrates that gaming device 200 includes an RNG 212 that utilizes hardware and/or software to generate RNG outcomes that lack any pattern. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more embodiments, RNG 212 could be one of a set of RNGs operating on gaming device 200. Game developers could vary the degree of true randomness for each RNG (e.g., pseudorandom) and utilize specific RNGs depending on game requirements.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). FIG. 2A illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2A also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Although FIGS. 1 and 2A illustrates specific embodiments of a gaming device (e.g., gaming devices 104A-104X and 200), the disclosure is not limited to those embodiments shown in FIGS. 1 and 2A. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards. Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface). Gaming devices 104A-104X and 200 may also include other processors that are not separately shown. Using FIG. 2A as an example, gaming device 200 could include display controllers (not shown in FIG. 2A) configured to receive video input signals or instructions to display images on game displays 240 and 242. Alternatively, such display controllers may be integrated into the game controller 202. The use and discussion of FIGS. 1 and 2A are examples to facilitate ease of description and explanation.

Figure 2B:
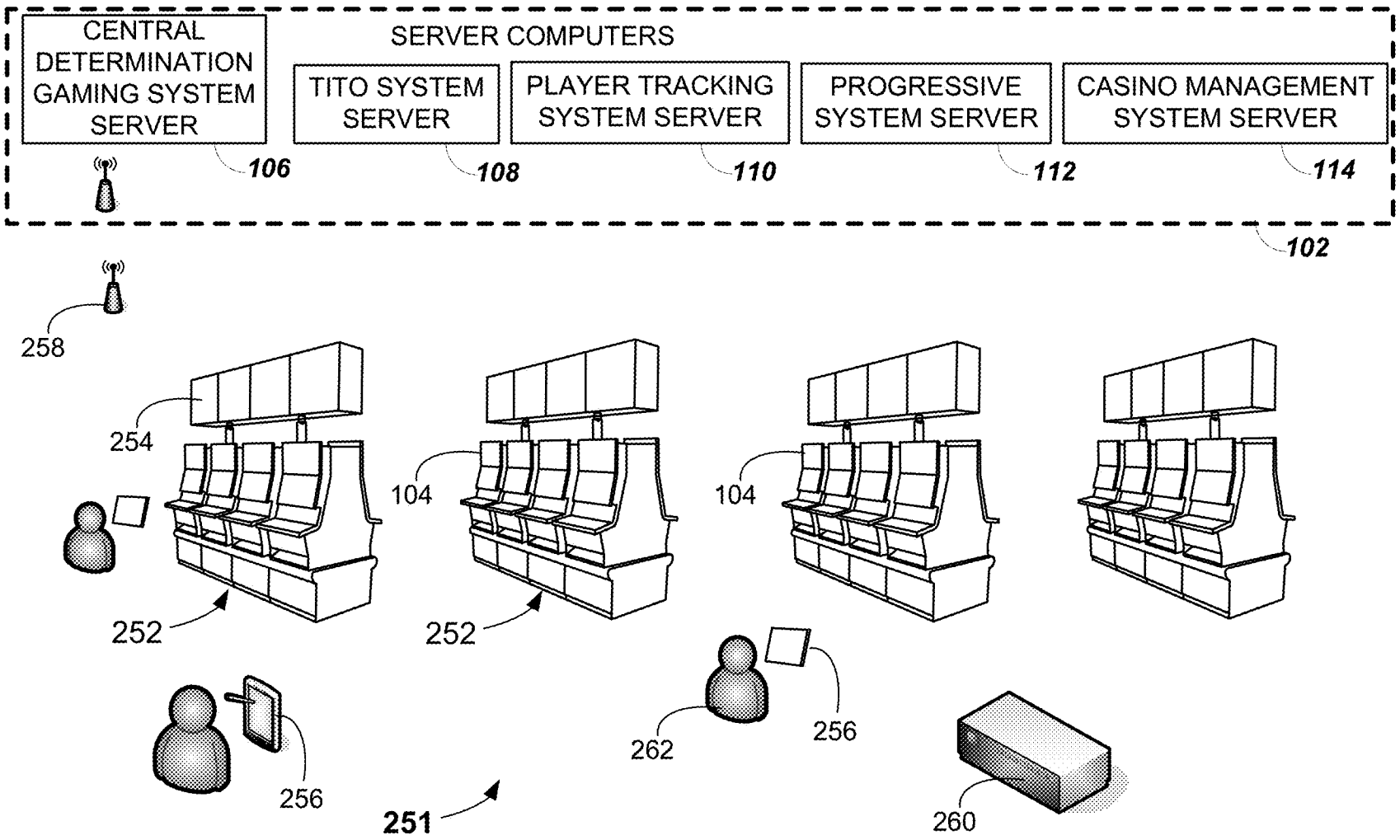
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254. According to this implementation, the casino 251 also includes mobile gaming devices 256, which are also configured to present wagering games in this example. The mobile gaming devices 256 may, for example, include tablet devices, cellular phones, smart phones and/or other hand-held devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
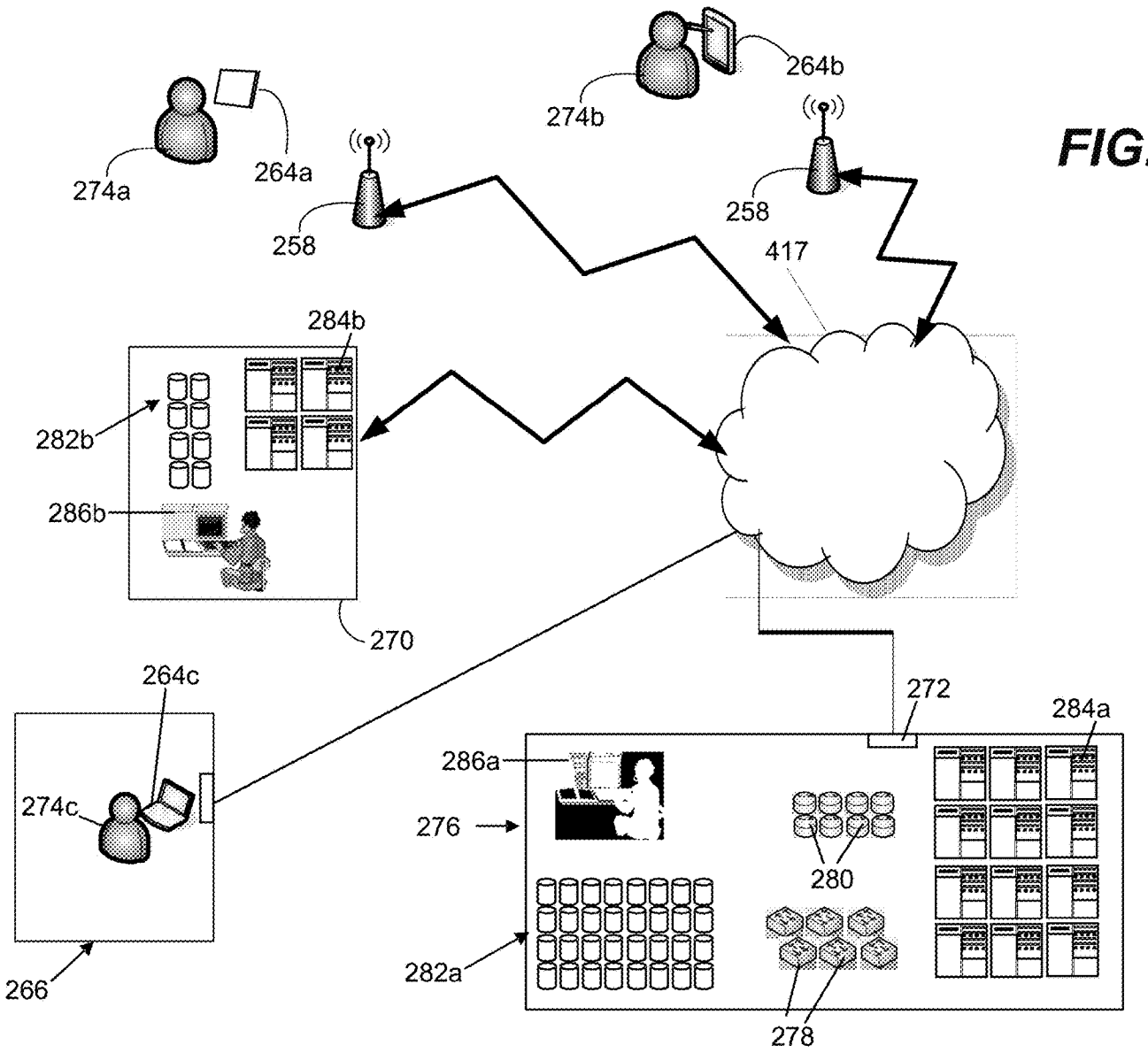
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3:
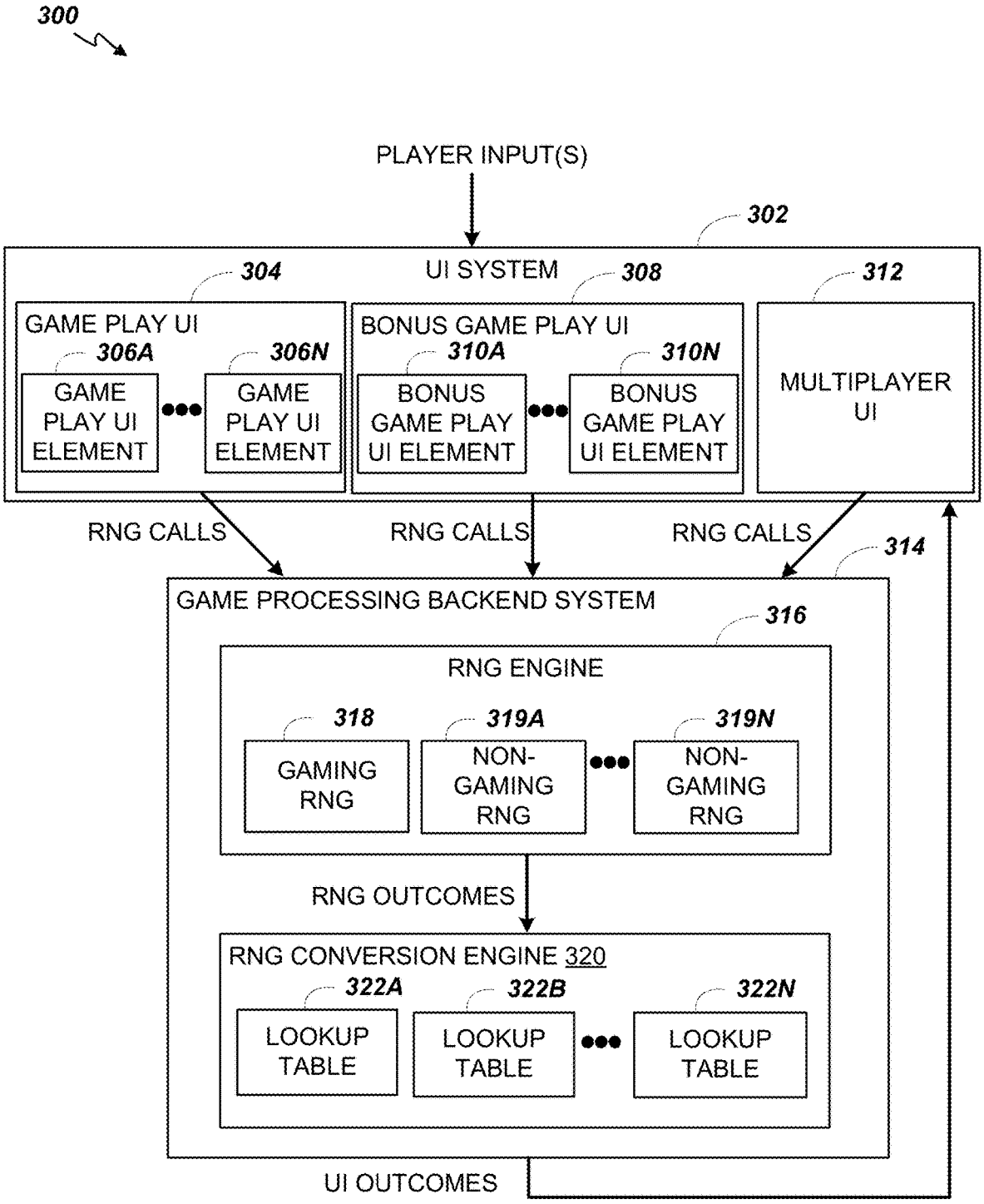
FIG. 3 illustrates, in block diagram form, an embodiment of a game processing architecture that implements a game processing pipeline for the play of a game in accordance with various embodiments described herein.

FIG. 3 illustrates, in block diagram form, an embodiment of a game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2A, respectively. Alternatively, portions of the gaming processing architecture 300 can implement the game processing pipeline using a gaming device and one or more remote gaming devices, such as central determination gaming system server 106 shown in FIG. 1. In some such examples, the game processing pipeline may include a gaming device and one or more servers 284*a* of the gaming data center 276 shown in FIG. 2C. According to some such implementations, the gaming device may be a mobile device such as described above with reference to FIG. 2B or an EUD as described above with reference to FIG. 2C.

The UI system 302 includes one or more UIs that a player can interact with. The UI system 302 could include one or more game play UIs 304, one or more bonus game play UIs 304, and one or more multiplayer UIs 306, where each UI type includes one or more mechanical UIs and/or graphical UIs (GUIs). In other words, game play UI 304, bonus game play UI 304, and the multiplayer UI 304 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from to the bonus game play UI elements 310A-310N.

FIG. 3 also illustrates that UI system 302 could include a multiplayer UI 312 purposed for game play that differ or is separate from the typical base game. For example, multiplayer UI 302 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play.

After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator (PRNG) (e.g., Fortuna PRNG) that securely produces random numbers for one or more game features. To generate random numbers, gaming RNG 318 could collect random data from various sources of entropy, such as from an operating system (OS). Alternatively, non-gaming RNGs 319A-319N may not be cryptographically secure and/or be computational less expensive. Non-gaming RNGS 319A-319N can, thus, be used to generate outcomes for non-gaming purposes. As an example, non-gaming RNGs 319A-319N can generate random numbers for such as generating random messages that appear on the gaming device. The RNG conversion engine 320 processes each RNG outcome from RNG engine 316 and converts the RNG outcome to a UI outcome that is feedback to the UI system 302. With reference to FIG. 2, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome to the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to the updating the appropriate UI, the player may subsequently provide additional player inputs to initiate a subsequent game instance that progresses through the game processing pipeline.

FIG. 3 shows examples of lookup tables 322A . . . 322N, which are also called weighted tables. In general, a weighted table can be implemented as any data structure that assigns probabilities to different options, in order for one of the different options to be selected using a random number. Different options are represented in different entries of a weighted table. The probabilities for different options can be reflected in threshold values (e.g., 1<RAID<=40 for option 1, 40<RAID<=70 for option 2, 70<RND<=90 for option 3, and 90<RAID<=100 for option 4, given four options and a random number RAID where 0<RAID<=100). The threshold values can represent percentages or, more generally, sub-ranges within the range for a random number. In some example implementations, the threshold values for a weighted table are represented as count values for the respective entries of the weighted table. For example, the following table shows count values for the four options described above:

TABLE 1

Example Weighted Table

| count value | entry |
|---|---|
| 40 | <value a1, value a2, . . . > |
| 30 | <value b1, value b2, . . . > |
| 20 | <value c1, value c2, . . . > |
| 10 | <value d1, value d2, . . . > |

The sum total of the count values indicates the range of the options. Control logic can use a random number, generated between 1 and the sum total of the count values, to select one of the entries in the weighted table by comparing the random number to successive running totals. In the example shown in Table 1, if the random number is 40 or less, the first entry is selected. Otherwise, if the random number is between 41 and 70, the second entry is selected. Otherwise, if the random number is between 71 and 90, the third entry is selected. Otherwise, the last entry is selected.

The threshold values for a weighted table can be fixed and pre-determined. Or, the threshold values for a weighted table can vary dynamically (e.g., depending on bet level). Or, a weighted table can be dynamically selected (e.g., depending on bet level) from among multiple available weighted tables. Different parameters or choices during game play can use different weighted tables. Or, different combinations of parameters or choices can be combined in entries of a given weighted table.

According to some examples, the example game processing architecture 300 shown in FIG. 3 can be used to process game play instructions and generate outcomes as shown and described herein. In response to user input received via an interface system for initiation of an instance of a wagering game (e.g., an indication of user input from a "play" button), the game play UI 304 may make one or more RNG calls to the game processing backend system 314 for determining a game outcome and corresponding display symbols for the instance of the wagering game. According to some examples, the wagering game may be a slot game.

In some instances, one or more RNG calls may be made to determine whether a game outcome presentation will include wild symbols in at least one entire display symbol row or at least an entire display symbol column and, if so, in which display symbol rows and/or columns the wild symbols will be presented. In some such examples, the determination will be subsequent to receiving an indication that a corresponding game feature has been selected by a player.

In response, the backend system 314 may perform various operations. Using a gaming RNG 318, the RNG engine 316 may generate one or more random numbers, which may be passed to the RNG conversion engine 320. The RNG conversion engine 320 may use the one or more random numbers (along with one or more of the lookup tables 322A-322N) to determine symbol stop positions for the active reels. The RNG conversion engine 320 may use one or more other random numbers (along with one or more of the lookup tables 322A-322N) to determine whether a game outcome presentation will include wild symbols in at least an entire display symbol row or at least an entire display symbol column. If so, the RNG conversion engine 320 may use one or more other random numbers (along with one or more of the lookup tables 322A-322N) to determine in which display symbol rows and/or columns the wild symbols will be presented. The backend system 314 may also determine the outcome of the process (e.g., calculating whether any win conditions exist on pay lines, etc.

In some instances, a control system will automatically select game features for certain types of games, such as free games. In some such examples, a control system will automatically and randomly select a game feature for each free game instance. In some instances, the one or more RNG calls may include an RNG call to the RNG engine 316 in order to determine which game feature will be selected for a free game instance. The RNG conversion engine 320 may use the one or more random numbers (along with one or more of the lookup tables 322A-322N) to determine a corresponding configuration of a GUI to indicate a selected game feature.

Figure 4:
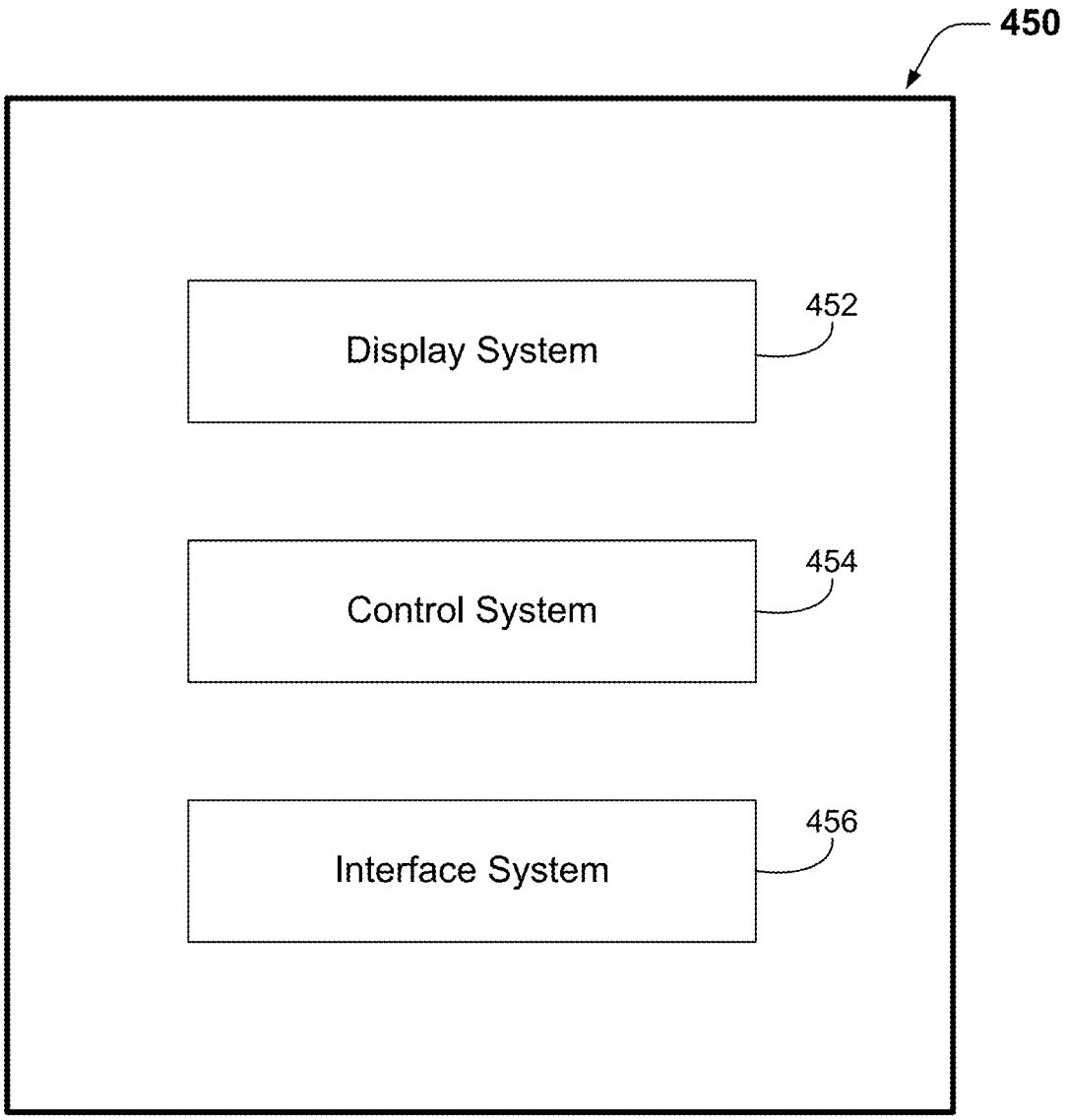
FIG. 4 is a block diagram that shows blocks of an apparatus according to one example.

FIG. 4 is a block diagram that shows blocks of an apparatus according to one example. According to some examples, the apparatus 450 may be, or may include, a gaming device. In some examples, the apparatus 450 may be an EGM such as those described above with reference to FIGS. 1 and 2A. However, in alternative examples, the apparatus 450 may be a mobile device such as described above with reference to FIG. 2B or an EUD as described above with reference to FIG. 2C.

In this example, the apparatus 450 includes a display system 452 and a control system 454 that is configured to communicate with the display system 452. In this example, the control system 454 is configured to communicate with the display system 452 via wired communication, e.g., via electrical signals. In alternative implementations, the control system 454 may be configured to communicate with the display system 452 via wireless communication. Accordingly, at least a portion of the control system 454 may be coupled to the display system 452. As used herein, the term "coupled to" has a meaning that could include being physically coupled for wired communication or being configured for wireless communication.

The control system 454 may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. Although the interface system 456 is shown as being separate from the control system 454, in some implementations the interface system 456 may be part of the control system 454. In some implementations, the interface system 456 may include the entire control system 454. The control system 454 also may include (and/or be configured for communication with) one or more memory devices, such as one or more random access memory (RAM) devices, read-only memory (ROM) devices and/or other types of non-transitory media. In some implementations, at least a portion of the control system 454 may be implemented as a register. Accordingly, the apparatus 450 may have a memory system that includes one or more memory devices, though the memory system is not shown in FIG. 4.

The control system 454 may be capable of performing, at least in part, the methods disclosed herein. In some examples, the control system 454 may be capable of performing at least some of the methods described herein according to instructions (e.g., software) stored on one or more non-transitory media. For example, the control system 454 may be configured for controlling the display system 452 and/or for receiving and processing data from at least a portion of the display system 452, e.g., as described below.

The display system 452 may include, one or more liquid crystal displays (LCDs), plasma displays, light-emitting diode (LED) displays, micro LED displays or organic light-emitting diode (OLED) displays. According to some implementations, the display system 452 may include at least one flexible display, such as a flexible OLED. Although shown as separate components in FIG. 4, the display system 452 may, in some examples, include at least a portion of the control system 454. For example, the display system 452 may include one or more processors, microprocessors, programmable logic devices, discrete gates or transistor logic, etc.

In the example shown in FIG. 4, the apparatus 450 includes an interface system 456. In some examples, the interface system may include a wireless interface system. In some implementations, the interface system 456 may include a network interface, an interface between the control system 454 and the display system 452, an interface between the control system 454 and a memory system and/or an interface between the control system 454 and an external device interface (e.g., a port or an applications processor). In some examples, the interface system 456 may include one or more user interfaces, such as a touch screen, one or more buttons, a gesture recognition system, a voice recognition system, etc. According to some examples, the interface system 456 may include a credit input system.

According to some implementations, the apparatus 450 may be a single device, whereas in other implementations the apparatus 450 may be a system that includes more than one device. Accordingly, the terms "apparatus" and "system" may sometimes be used interchangeably herein. In other examples, the apparatus 450 may be a component of another device. For example, in some implementations at least a portion of the display system 452 and/or the control system 454 may be included in more than one apparatus. For example, in some implementations at least part of the control system 454 may reside in a server, such as a central determination server or a gaming data center server. Some implementations of the apparatus 450 may not include a display system. In some such implementations, the control system 454 may be configured for controlling the display system of another device.

Figure 5:
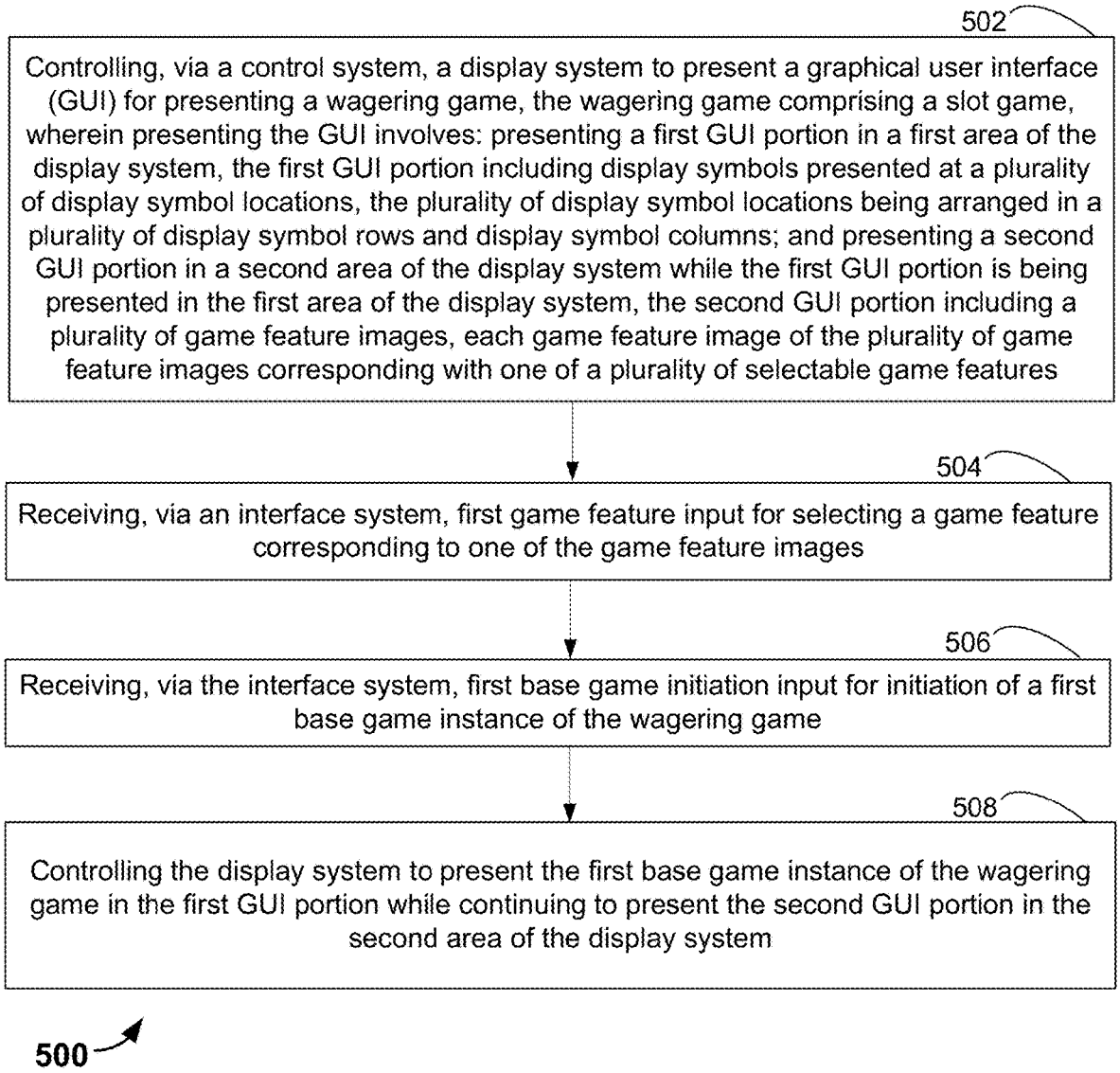
FIG. 5 is a flow diagram that shows blocks of a method according to one example.

FIG. 5 is a flow diagram that shows blocks of a method according to one example. In some examples method 500 may be performed, at least in part, by an apparatus such as that described above with reference to FIG. 4. In some examples, the method 500 may be performed, at least in part, by a control system (e.g., the control system 454 of FIG. 4) according to software stored upon one or more non-transitory storage media. According to some examples the method 500 may be performed, at least in part, by a server, such as a central determination server or a gaming data center server.

As with other methods described herein, the number and sequence of blocks shown in FIG. 5 are merely examples.

Similar disclosed methods may include more or fewer blocks. Moreover, at least some of the blocks may occur in a different sequence than the sequence that is shown in a flow diagram. In some examples, operations corresponding to at least some of the blocks may be performed concurrently.

In this example, block 502 involves controlling, via a control system, a display system to present a graphical user interface (GUI) for presenting a wagering game. In some examples, the control system and the display system may correspond to the control system 454 and the display system 452 of FIG. 4. According to this example, the wagering game is, or includes, a slot game.

In this embodiment, presenting the GUI involves presenting a first GUI portion in a first area of the display system. According to this example, the first GUI portion includes display symbols presented at a plurality of display symbol locations. In this instance, the plurality of display symbol locations are arranged in a plurality of display symbol rows and display symbol columns.

In this example, presenting the GUI involves presenting a second GUI portion in a second area of the display system while the first GUI portion is being presented in the first area of the display system. In this embodiment, the second GUI portion includes a plurality of game feature images and each game feature image corresponds with one of a plurality of selectable game features.

According to this example, block 504 involves receiving, via an interface system, user input for selecting a game feature corresponding to one of the game feature images. The interface system may, in some instances, include at least one user interface, such as a touch sensor system, a gesture detection system, a voice user interface, one or more buttons, a mouse, a track ball, a keyboard, etc. The interface system may, in some instances, include at least one network interface. Block 504 may, for example, involve receiving an indication that a user has pressed a button to select the game feature, has provided input to an area of a graphical user interface (GUI) for selecting the game feature (e.g., via a touch screen, a touch pad, a mouse, etc.). In some implementations, a game feature may be selected by the control system, e.g., according to a randomized process. Some such implementations involve free games, examples of which are described below. However, some alternative base game implementations also may involve a game feature being selected by the control system.

In this example, block 506 involves receiving, via the interface system, first base game initiation input for initiation of a first base game instance of the wagering game. For example, the user input may be received by the control system 454 of FIG. 4, via a user interface of the interface system 456. Block 506 may, for example, involve receiving an indication that a user has pressed a "play" button of a gaming device, receiving an indication that the user has touched an area of a touch screen that corresponds to a displayed image of a "play" button, etc. In some such implementations, block 504, block 506 or a preceding block of method 500 may involve verifying that there is sufficient credit for at least one instance of a game. According to some such implementations, the method 500 may be performed by a gaming device that includes apparatus for receiving monetary credit, which may be considered as part of an interface system.

According to this implementation, block 508 involves controlling the display system to present the first base game instance of the wagering game in the first GUI portion while continuing to present the second GUI portion in the second area of the display system. Block 508 may, for example, involve determining, via the control system, a first base game outcome and corresponding first display symbols for the first base game instance of the wagering game. Block 508 may involve controlling the display system to display the first base game outcome in the first GUI portion.

According to some examples, receiving the first game feature input in block 504 may involve receiving user input for selecting a first game feature. In some examples, the first game feature may potentially cause the removal of at least one display symbol from a full set of display symbols that is potentially available for selection during an instance of a slot game. In some such examples, the full set of display symbols may include lower-value display symbols and higher-value display symbols. The at least one removed display symbol may, in some examples, be a lower-value display symbol. In some implementations, after the first game feature has been selected, there may be a determination (e.g., during each game instance) of whether the first game feature will be triggered. The determination may be a random determination.

Figure 6:
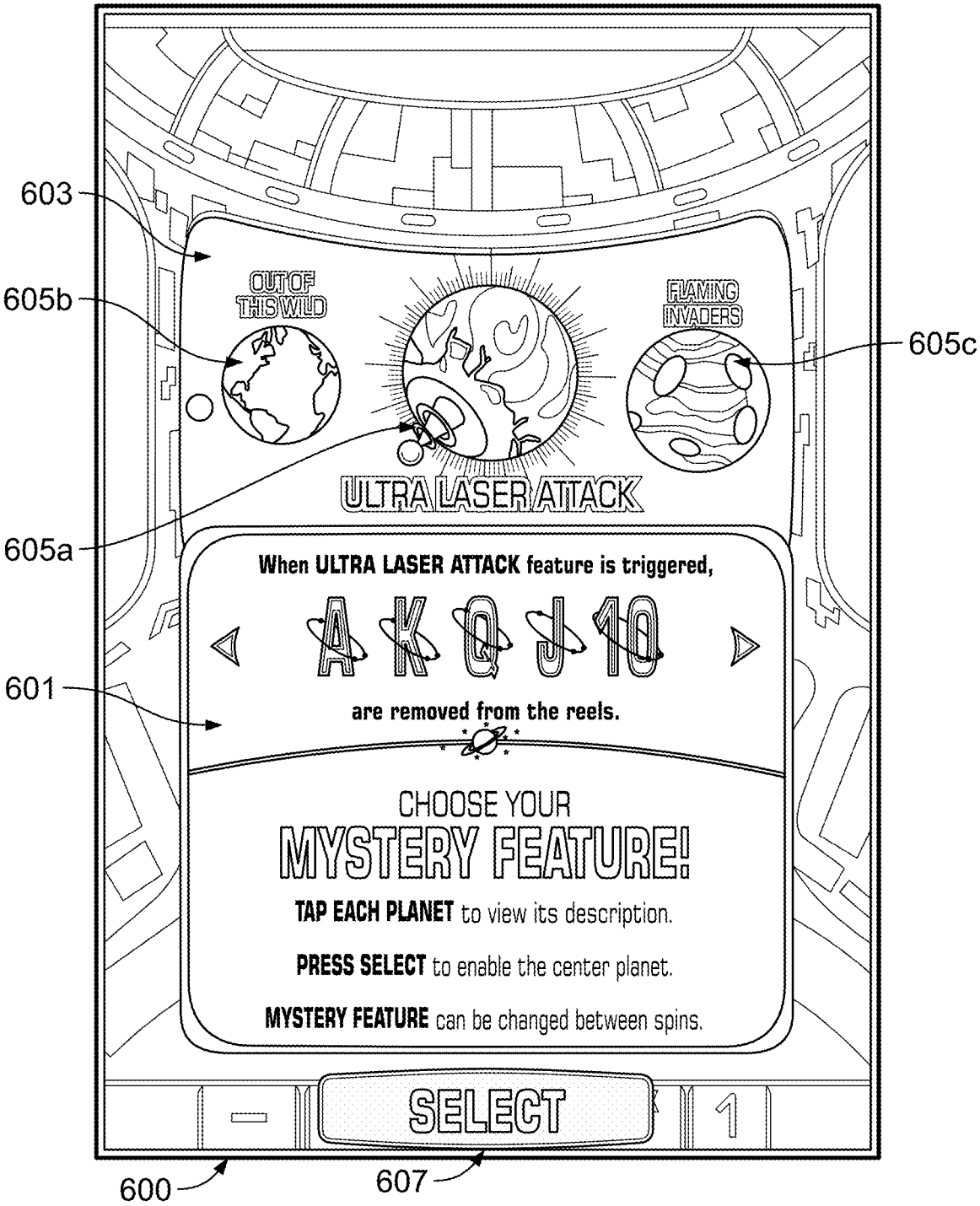
FIG. 6 shows an example of a display that may be presented according to some implementations of the method of FIG. 5.

FIG. 6 shows an example of a display that may be presented according to some implementations of the method of FIG. 5. As with other implementations provided herein, the particular types of elements, the particular numbers of elements and the particular arrangement of elements shown in FIG. 6 are merely examples.

In some instances, the display 600 may be used to present an online wagering game, e.g., on an end user device (EUD) such as one of the EUDs 264*a*, 264*b* or 264*c* shown in FIG. 2C and described above. However, in alternative implementations the display 600 may be used to present a casino-based wagering game, e.g., on a gaming device such as one of the gaming devices 104A-104X that are shown in FIG. 1.

In this example, the display 600 is an example of a GUI that may be used to present instances of a wagering game that includes user-selectable game features. In this example, the GUI includes a first GUI portion 601 and a second GUI portion 603. At the time represented by FIG. 6, the first GUI portion 601 is providing text that describes aspects of a first game feature, which is the "Ultra Laser Attack" game feature in this example. The text may, for example, have been displayed in response to user input corresponding to a user's request for information. In some implementations, explanatory text regarding a game feature may not be presented in the first GUI portion 601.

A first game feature image 605*a* shown in the second GUI portion 603 represents, and corresponds to, the first game feature. A second game feature image 605*b* and a third game feature image 605*c* are also shown in the second GUI portion 603 in this example. Other implementations may provide more or fewer game features and/or game feature images.

The terms "first," "second," "third," etc., as used herein do not necessarily imply a temporal (or other) sequence. For example, the terms "first game feature image 605*a*," "second game feature image 605*b*" and "third game feature image 605*c*" are merely used to distinguish one game feature image from another and have no temporal significance. Similarly, the "first base game instance" that is described above with reference to FIG. 5 is not necessarily the actual first base game instance of a gaming session. Instead, in that context the term "first" is merely used to reference a particular base game instance.

By interacting with the second GUI portion 603 and/or other portions of the display 600, a user may select a game feature corresponding to any one of the displayed game feature images. For example, a user may interact with one or more aspect of a user interface system, such as the user interface system 456 described above with reference to FIG. 4, in order to select a game feature corresponding to any one of the displayed game feature images. For instance, a user may touch an area of a touch screen corresponding to the virtual Select button 607 in order to select a game feature corresponding to a game feature image that is shown in the central area of the second GUI portion 603, which is where the first game feature image 605*a* is being displayed in FIG. 6. Alternatively, a user may touch an area of a touch screen corresponding to one of the game feature images shown in the second GUI portion 603 in order to select the corresponding game feature.

As shown in the first GUI portion 601, a player can tap a game feature image in order to have information displayed in the first GUI portion 601 regarding the corresponding game feature. In this example, a player has previously touched an area of the second GUI portion 603 in which the first game feature image 605*a* was displayed. In this embodiment, a selected game feature image is rotated to the central area of the second GUI portion 603 and enlarged.

As shown in the first GUI portion 601, in this example the first game feature potentially causes the ace, king, queen, jack and 10 slot symbols to be removed from the "reels," meaning that these symbols could potentially be removed from the a full set of display symbols that is otherwise potentially available for selection during an instance of a slot game. In some implementations, after the first game feature has been selected, there may be a determination (e.g., during each game instance) of whether the first game feature will be triggered. The determination may be a random determination, e.g., based on applying the result of an RNG call to a weighted table.

In some examples, a pay table may indicate that the number of credits that may potentially be obtained based on winning combinations of the ace, king, queen, jack and 10 slot symbols are lower than the number of credits that may potentially be obtained based on winning combinations of other symbols, such as picture symbols. Accordingly, removing the ace, king, queen, jack and 10 slot symbols is an example of removing at least one display symbol from a full set of display symbols that is potentially available for selection during an instance of a slot game. The instance may be a base game instance, as in this example. According to some implementations, the first game feature may be enabled during a free game instance. In some examples, as here, the full set of display symbols includes lower-value display symbols and higher-value display symbols. As noted above, in this example the ace, king, queen, jack and 10 slot symbols all have a lower value than the symbols remaining after triggering the first game feature. Accordingly, when the first game feature is triggered, this causes the removal of all of the lower-value display symbols in this implementation. Some embodiments may involve a randomized process of determining what symbol(s) will replace the removed symbols.

However, some alternative embodiments may involve a randomized process of determining what symbol(s) to remove. In some such examples, determining whether to remove the at least one display symbol may involve making at least one random number generator (RNG) call, receiving a result of the at least one RNG call and determining whether to remove at least one display symbol by applying the result of the at least one RNG call to at least one weighted table corresponding to the first game feature.

Figure 7:
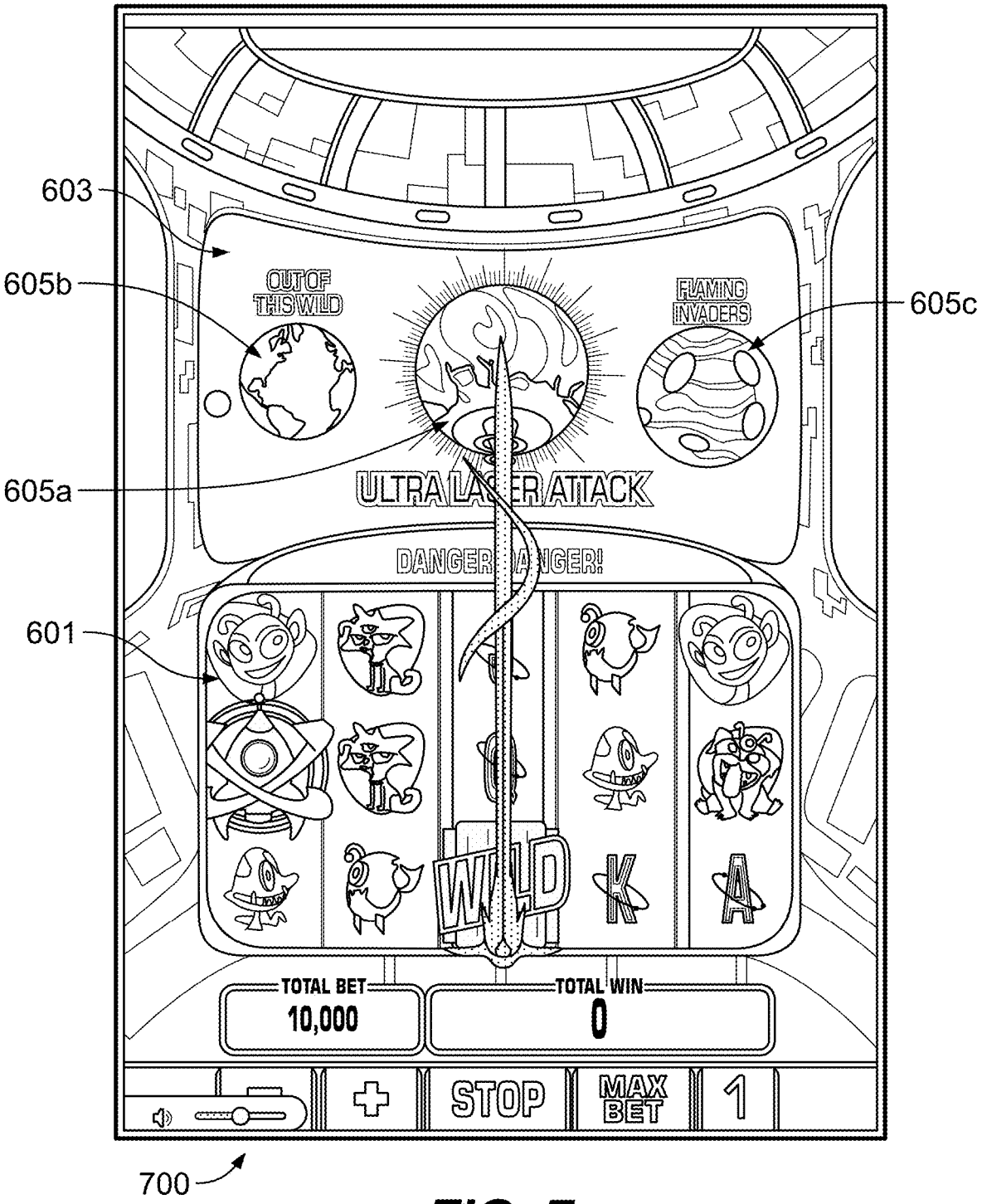
FIG. 7 shows an example of a display that may be presented after that of FIG. 6 according to some implementations.

FIG. 7 shows an example of a display that may be presented after that of FIG. 6 according to some implementations. In this example, the first GUI portion 601 is now presenting display symbols at a plurality of display symbol locations, the plurality of display symbol locations being arranged in a plurality of display symbol rows and display symbol columns. According to this example, the first game feature has previously been selected and has now been triggered, e.g., according to a randomized process. In this example, because the operation of the first game feature has now been triggered, the first game feature image 605*a* is shown emitting a laser beam from the second GUI portion 603 to the first GUI portion 601.

Figure 8:
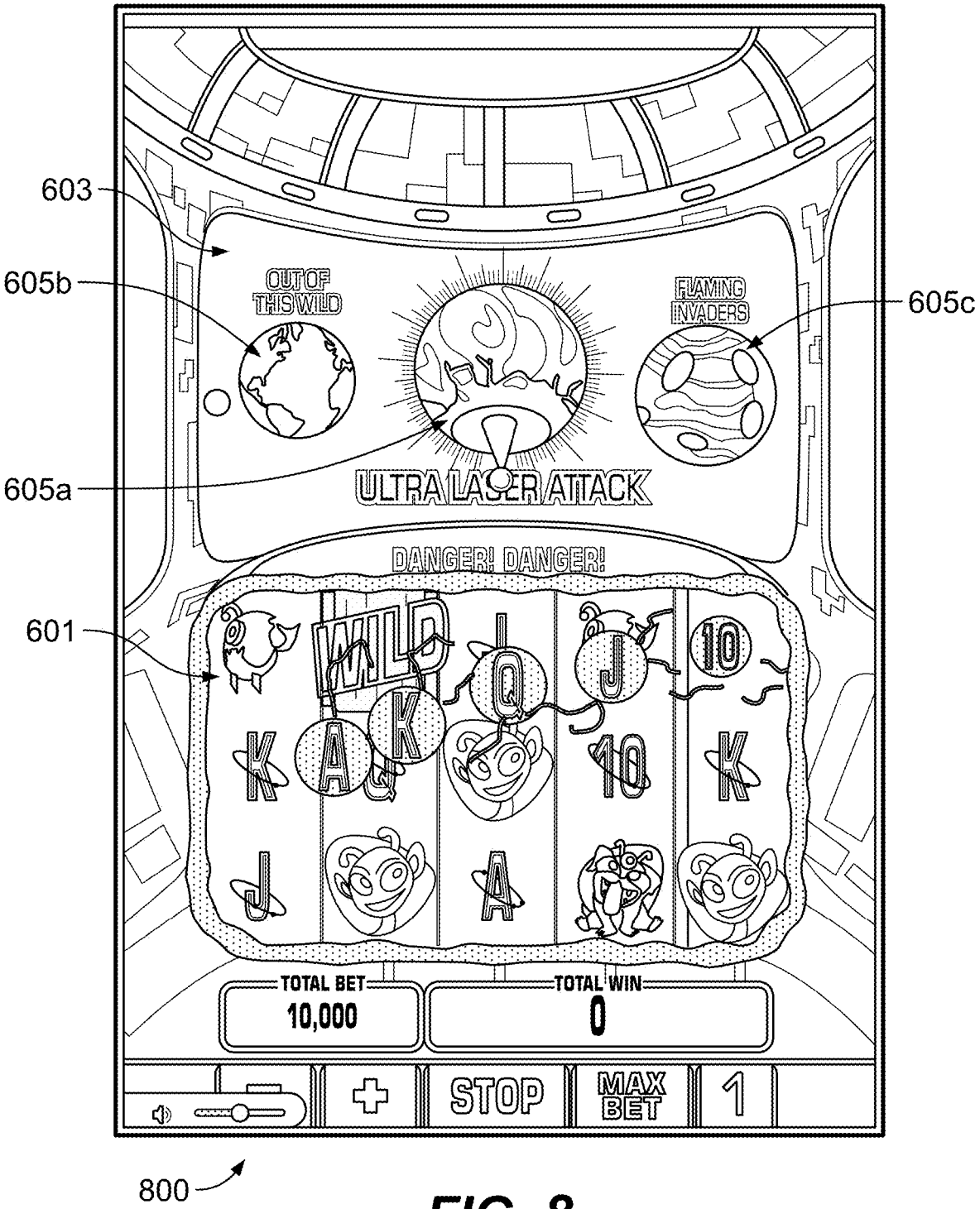
FIG. 8 shows an example of a display that may be presented after that of FIG. 7 according to some implementations.

FIG. 8 shows an example of a display that may be presented after that of FIG. 7 according to some implementations. In this example, the laser beam emitted by the first game feature image 605*a* is shown to be destroying the ace, king, queen, jack and 10 slot symbols.

Figure 9:
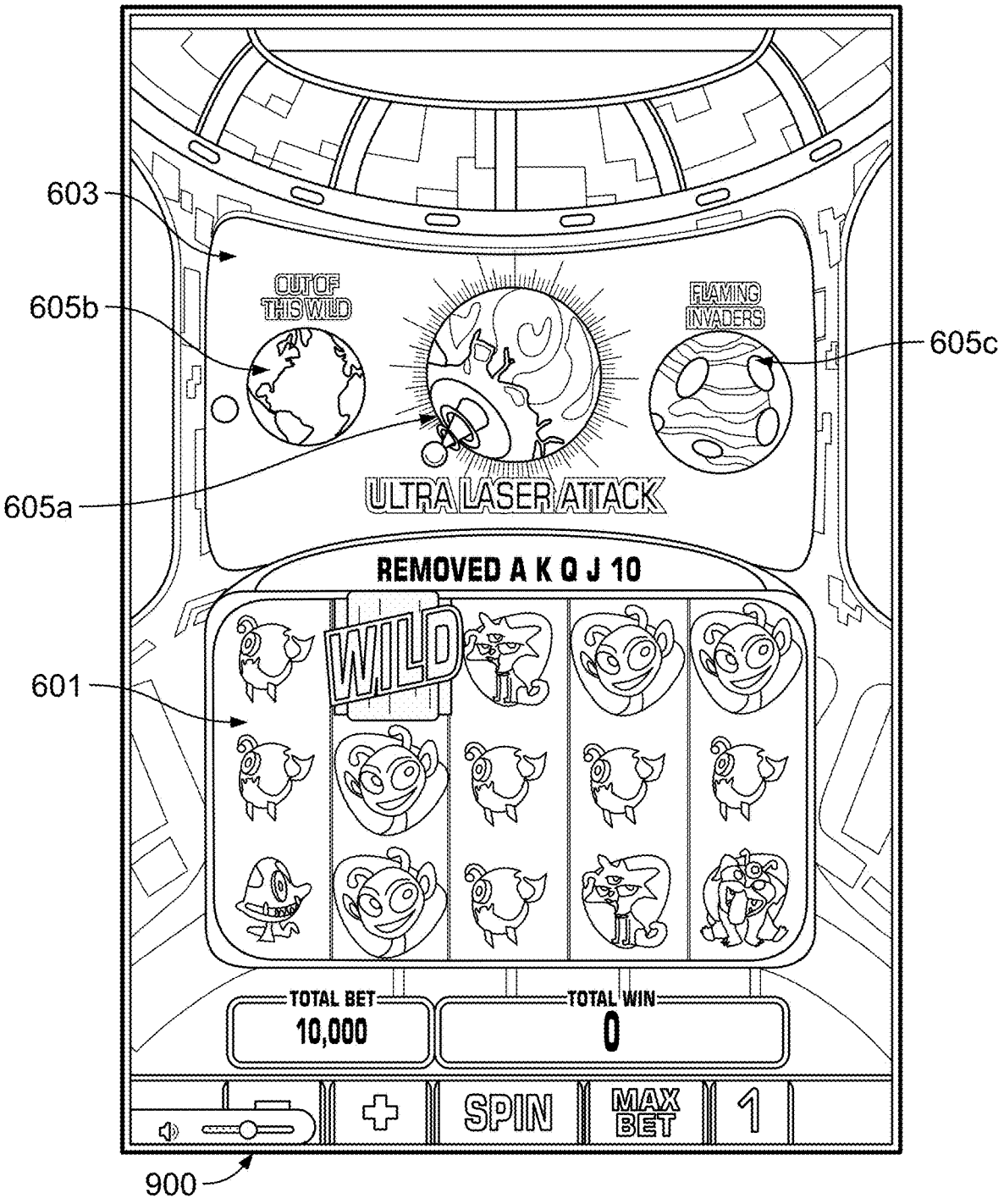
FIG. 9 shows an example of a display that may be presented after that of FIG. 8 according to some implementations.

FIG. 9 shows an example of a display that may be presented after that of FIG. 8 according to some implementations. In this example, the laser beam emitted by the first game feature image 605*a* has destroyed the ace, king, queen, jack and 10 slot symbols. Accordingly, the first GUI portion 601 is now configured for presenting an instance of a slot game corresponding to the first game feature, with the ace, king, queen, jack and 10 slot symbols removed from the full set of display symbols that would have potentially been available for selection during an instance of a slot game. Only the higher-value picture symbols now remain. In some implementations, this condition may persist during only one game instance after a game feature has been triggered. However, in other implementations this condition may persist during more than one game instance.

According to some examples, receiving the game feature input may involve receiving, via an interface system, user input for selecting a second game feature. Some such examples may involve receiving, via the interface system, second base game initiation input for initiation of a second base game instance of a slot game. Some such examples may involve presenting the second base game instance of the slot game in the first GUI portion while continuing to present the second GUI portion in the second area of the display system.

In some examples, determining a base game outcome when the second game feature is being implemented may involve determining whether to present wild symbols in at least an entire display symbol row or at least an entire display symbol column. For example, determining the base game outcome may involve determining whether to present wild symbols in one entire display symbol column, two entire display symbol columns, three entire display symbol columns, four entire display symbol columns or none of the display symbol columns.

Figure 10:
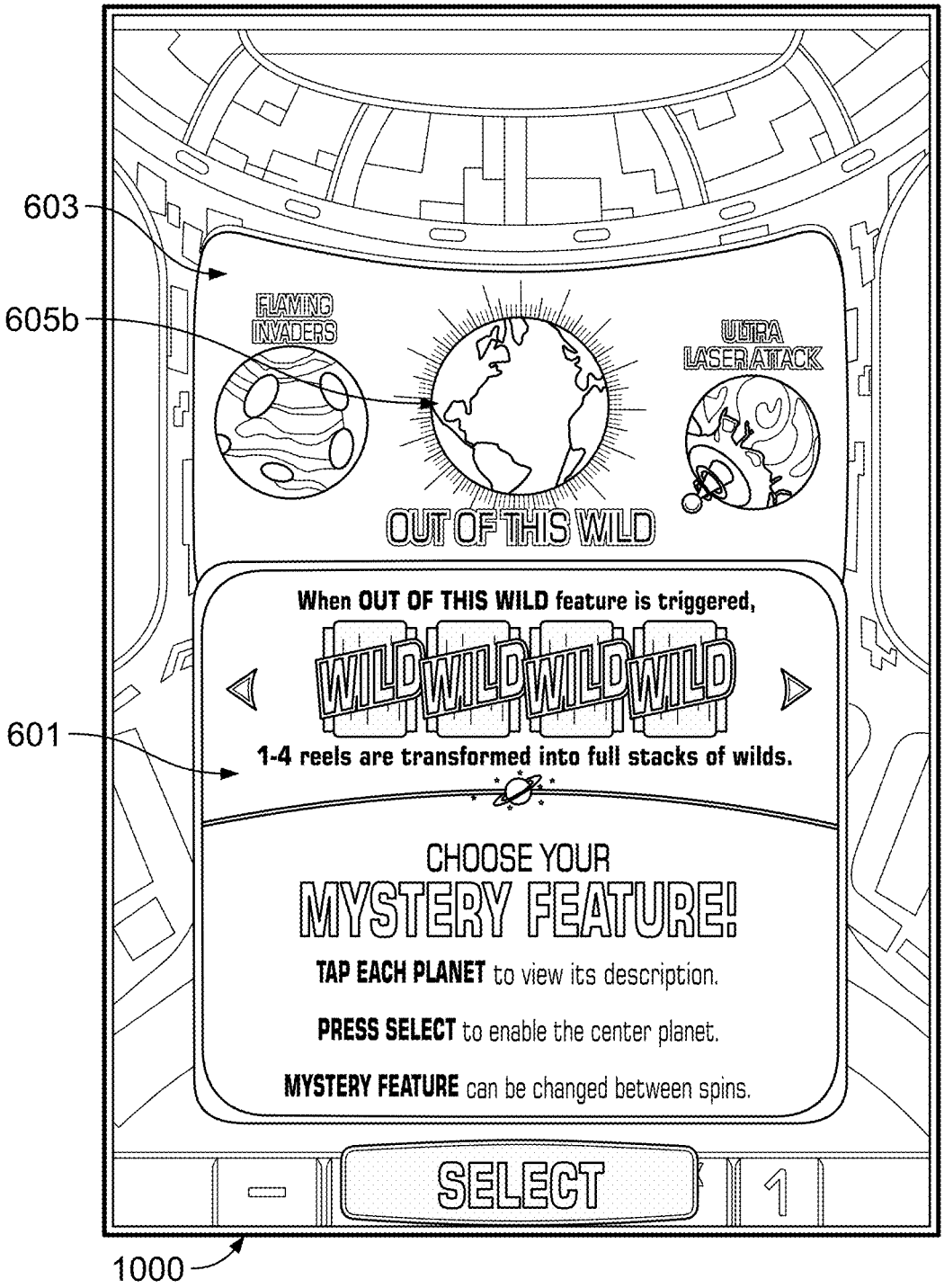
FIG. 10 shows an example of a display that may be presented according to some implementations of the method of FIG. 5.

FIG. 10 shows an example of a display that may be presented according to some implementations of the method of FIG. 5. As with other implementations provided herein, the particular types of elements, the particular numbers of elements and the particular arrangement of elements shown in FIG. 10 are merely examples. In this example, the display 1000 is another example of a GUI that may be used to present instances of a wagering game that includes user-selectable game features. At the time represented by FIG. 10, the first GUI portion 601 is providing text that describes aspects of a second game feature, which is the "Out of This Wild" game feature in this example. The text may, for example, have been displayed in response to user input corresponding to a user's request for information. In some implementations, explanatory text regarding a game feature may not be presented in the first GUI portion 601. A player may, for example, be able to simply select this game feature or another game feature while the first GUI portion 601 continues to show display symbol rows and display symbol columns for presenting a slot game.

As in the example described above with reference to FIG. 6, by interacting with the second GUI portion 603 and/or other portions of the display 600, a user may select a game feature corresponding to any one of the displayed game feature images. In this example, a player has previously touched an area of the second GUI portion 603 in which second game feature image 605*b* was displayed. In this embodiment, after selection the second game feature image 605*b* has been rotated to the central area of the second GUI portion 603 and enlarged.

As shown in the first GUI portion 601, in this example the second game feature involves determining whether to present wild symbols in at least an entire display symbol row or at least an entire display symbol column during an instance of a slot game. For example, determining a base game outcome (or a free game outcome) may involve determining whether to present wild symbols in one entire display symbol column, two entire display symbol columns, three entire display symbol columns, four entire display symbol columns or none of the display symbol columns.

Figure 11:
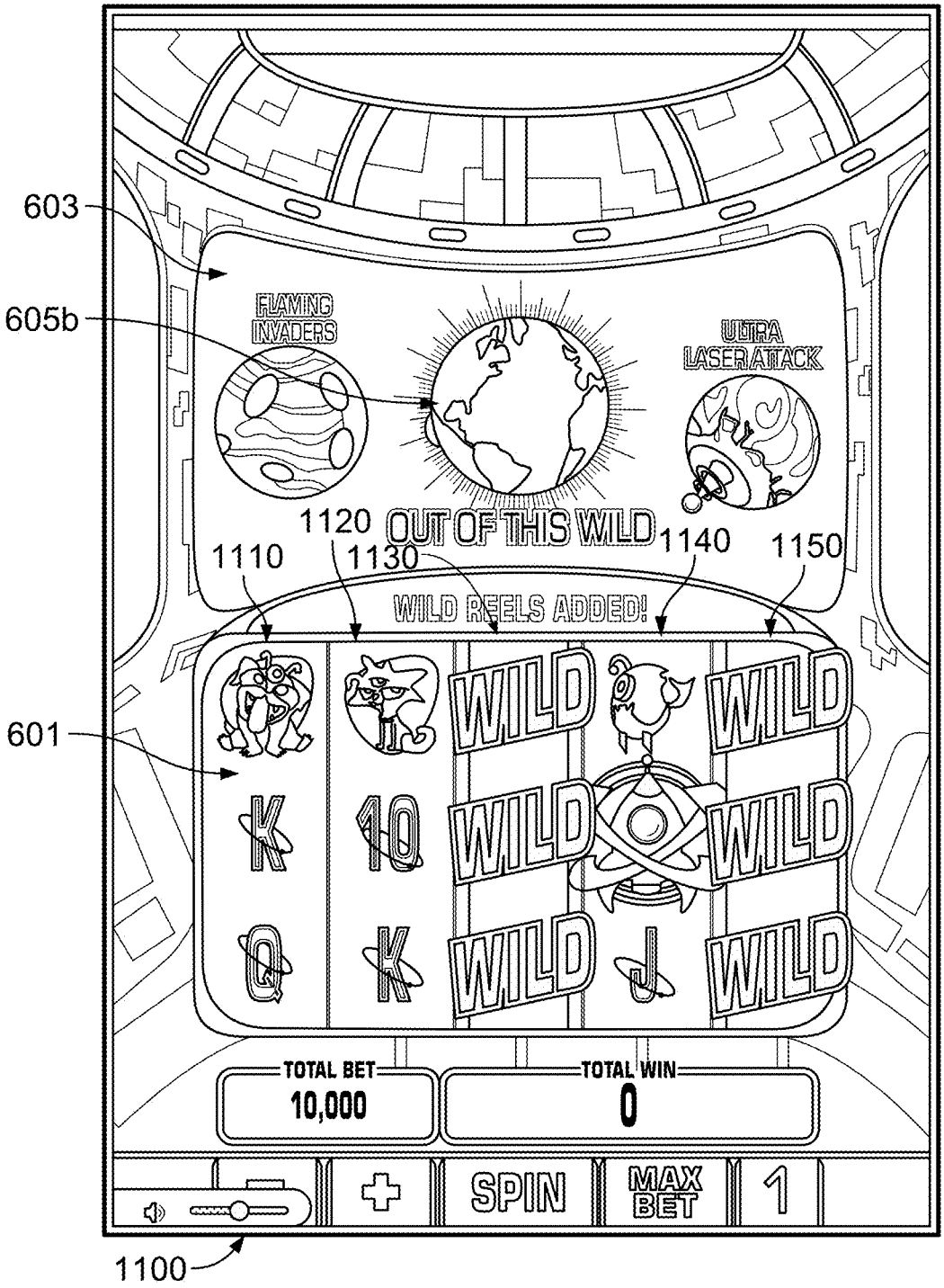
FIG. 11 shows an example of a display that may be presented after that of FIG. 10 according to some implementations.

FIG. 11 shows an example of a display that may be presented after that of FIG. 10 according to some implementations. In this example, the second game feature has previously been selected has now been triggered. The first GUI portion 601 is now presenting display symbols at a plurality of display symbol rows and display symbol columns. In this example, a base game outcome is being presented in the first GUI portion 601. According to this example, the base game outcome includes wild symbols in two entire display symbol columns, which are columns 1130 and 1150 in this particular instance. In some implementations, this condition may persist during only one game instance after a game feature has been triggered. However, in other implementations this condition may persist during more than one game instance.

According to some examples, determining a base game outcome may involve making at least one RNG call, receiving a result of the at least one RNG call and determining whether to present wild symbols in one entire display symbol column, two entire display symbol columns, three entire display symbol columns, four entire display symbol columns, all of the entire display symbol columns or none of the display symbol columns by applying the result of the at least one RNG call to at least one weighted table corresponding to the second game feature. Non-limiting examples of weighted tables for implementing aspects of the second game feature are shown below:

| Base V2 Feature Weighted Table | |
|---|---|
| Feature | 40 |
| No Feature | 960 |

V2 Feature Wild Reel Weighted Table

| R1 | R2 | R3 | R4 | R5 | ID | Weight |
|---|---|---|---|---|---|---|
| 0 | 0 | 0 | 1 | 0 | 00010 | 40 |
| 0 | 0 | 0 | 0 | 1 | 00001 | 20 |
| 0 | 1 | 0 | 0 | 0 | 01000 | 100 |
| 0 | 0 | 1 | 0 | 0 | 00100 | 100 |
| 0 | 1 | 0 | 1 | 0 | 01010 | 1590 |

-continued

| | | | | | | |
|---|---|---|---|---|---|---|
| 0 | 0 | 0 | 1 | 1 | 00011 | 2000 |
| 0 | 1 | 0 | 0 | 1 | 01001 | 1930 |
| 0 | 0 | 1 | 1 | 0 | 00110 | 1357 |
| 0 | 0 | 1 | 0 | 1 | 00101 | 1830 |
| 0 | 1 | 1 | 0 | 0 | 01100 | 1010 |
| 0 | 1 | 0 | 1 | 1 | 01011 | 6 |
| 0 | 1 | 1 | 1 | 0 | 01110 | 4 |
| 0 | 0 | 1 | 1 | 1 | 00111 | 6 |
| 0 | 1 | 1 | 0 | 1 | 01101 | 6 |
| 0 | 1 | 1 | 1 | 1 | 01111 | 1 |

According to this example, at least two weighted tables are involved. In this example, the "Weight" columns indicate the relative probability of obtaining a particular outcome, with higher numbers indicating a relatively higher probability. The base feature weighted table indicates the probability of triggering the second game feature. The feature wild reel weighted table is used for those instances in which the second game feature has been triggered. In this example, R1, R2, R3, R4 and R5 correspond to first, second, third, fourth and fifth display symbol columns of a display symbol matrix for presenting a slot game, such as columns 1110, 1120, 1130, 1140 and 1150, respectively, of FIG. 11. A one corresponds to a column of wild symbols and a zero corresponds to not having a column of wild symbols. According to this particular implementation, every outcome indicated by the larger weighted table will include at least one column of wild symbols. In other words, after the second game feature has been triggered, every outcome of a game instance will include at least one column of wild symbols.

According to some examples, receiving the game feature input may involve receiving user input for selecting a third game feature. In some such examples, when the third game feature is enabled, determining a game outcome may involve determining whether to remove all instances of at least a one display symbol from a full set of display symbols that would otherwise have been potentially available for selection during the instance of a slot game. In some such implementations, determining a game outcome may involve determining whether to remove all instances of picture-type display symbols from the full set of display symbols. According to some such examples, when the third game feature is enabled, determining a game outcome may involve determining whether to substitute a second display symbol for the removed symbol(s), e.g., for all instances of at least the first display symbol.

In some examples, determining a game outcome may involve making at least a first RNG call and a second RNG call, receiving a first result of the first RNG call and receiving a second result of the second RNG call. Determining a game outcome may involve determining, by applying the first result to a first weighted table corresponding to the third game feature, that all instances of at least a first display symbol will be removed from the full set of display symbols. Determining a game outcome may involve determining, by applying the second result to a second weighted table corresponding to the third game feature, the second display symbol that will replace the removed display symbol(s).

Figure 12:
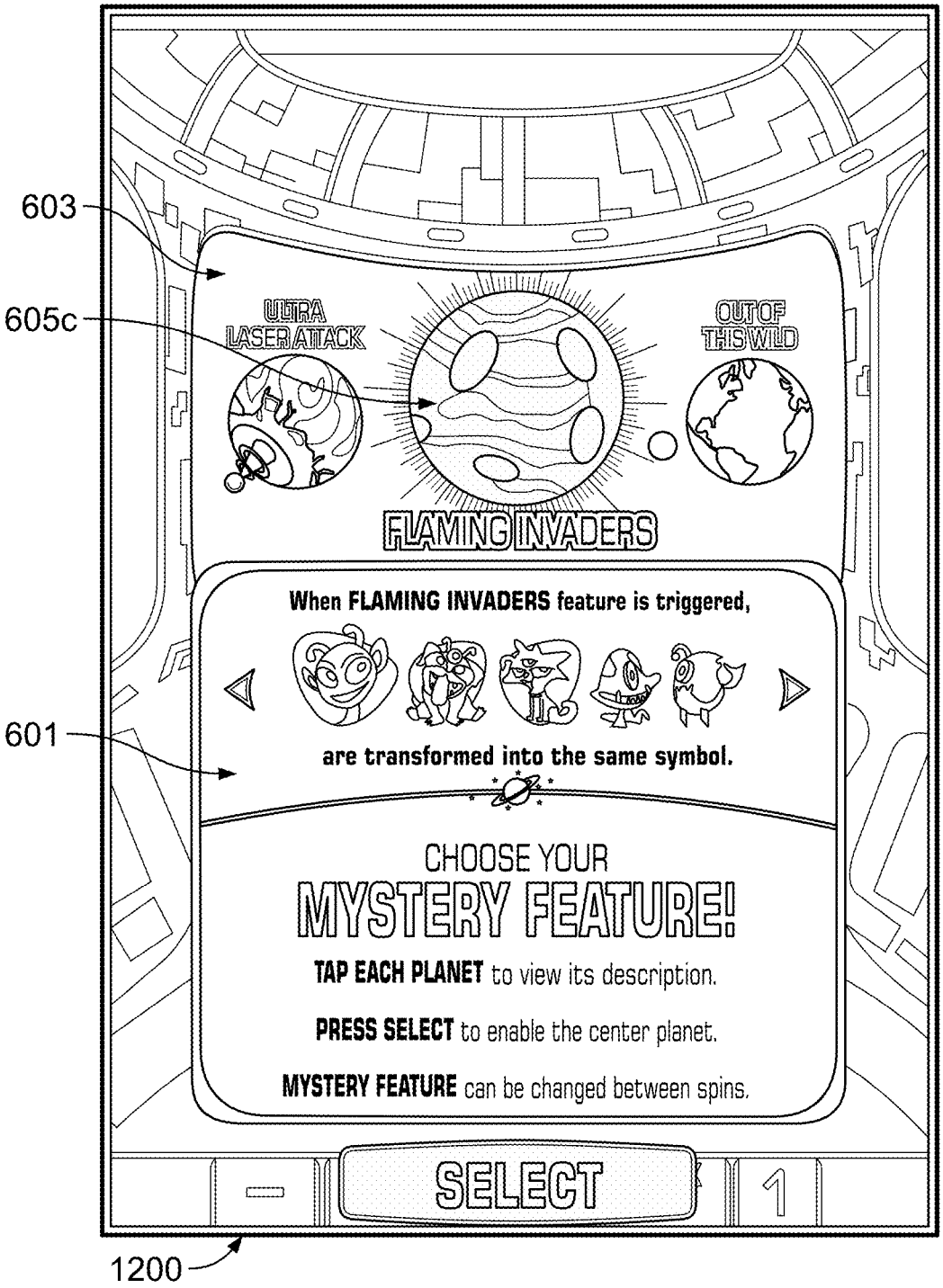
FIG. 12 shows an example of a display that may be presented according to some implementations of the method of FIG. 5.

FIG. 12 shows an example of a display that may be presented according to some implementations of the method of FIG. 5. As with other implementations provided herein, the particular types of elements, the particular numbers of elements and the particular arrangement of elements shown in FIG. 12 are merely examples. In this example, the display 1200 is another example of a GUI that may be used to present instances of a wagering game that includes user-selectable game features. At the time represented by FIG. 12, the first GUI portion 601 is providing text that describes aspects of a third game feature, which is the "Flaming Invaders" game feature in this example. The text may, for example, have been displayed in response to user input corresponding to a user's request for information. In some implementations, explanatory text regarding a game feature may not be presented in the first GUI portion 601. A player may, for example, be able to simply select this game feature or another game feature while the first GUI portion 601 continues to show display symbol rows and display symbol columns for presenting a slot game.

As in the example described above with reference to FIG. 6, by interacting with the second GUI portion 603 and/or other portions of the display 600, a user may select a game feature corresponding to any one of the displayed game feature images. In this example, a player has previously touched an area of the second GUI portion 603 in which the third game feature image 605*c* was displayed. In this embodiment, after selection the second game feature image 605*c* has been rotated to the central area of the second GUI portion 603 and enlarged. As shown in the first GUI portion 601, in this example the third game feature involves potentially transforming all of the picture symbols shown into the same symbol.

Figure 13:
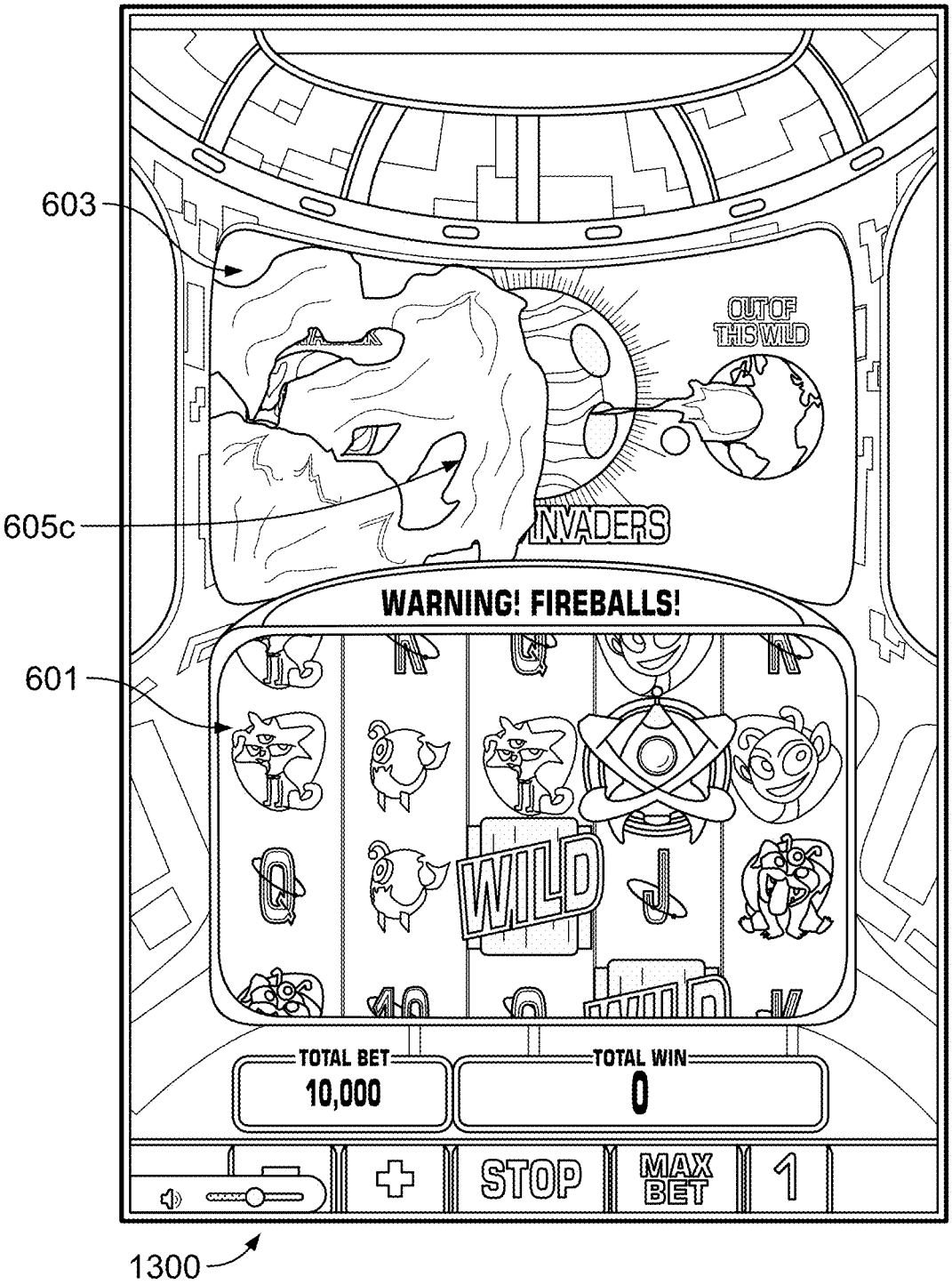
FIG. 13 shows an example of a display that may be presented after that of FIG. 12 according to some implementations.

FIG. 13 shows an example of a display that may be presented after that of FIG. 12 according to some implementations. The first GUI portion 601 is now presenting display symbols at a plurality of display symbol rows and display symbol columns. According to this example, a base game outcome is being presented in the first GUI portion 601.

In this example, the third game feature has previously been selected and has now been triggered. According to this example, the second GUI portion 603 is now presenting a transformed version of the third game feature image 605*c*, which is emitting fireballs.

Figure 14:
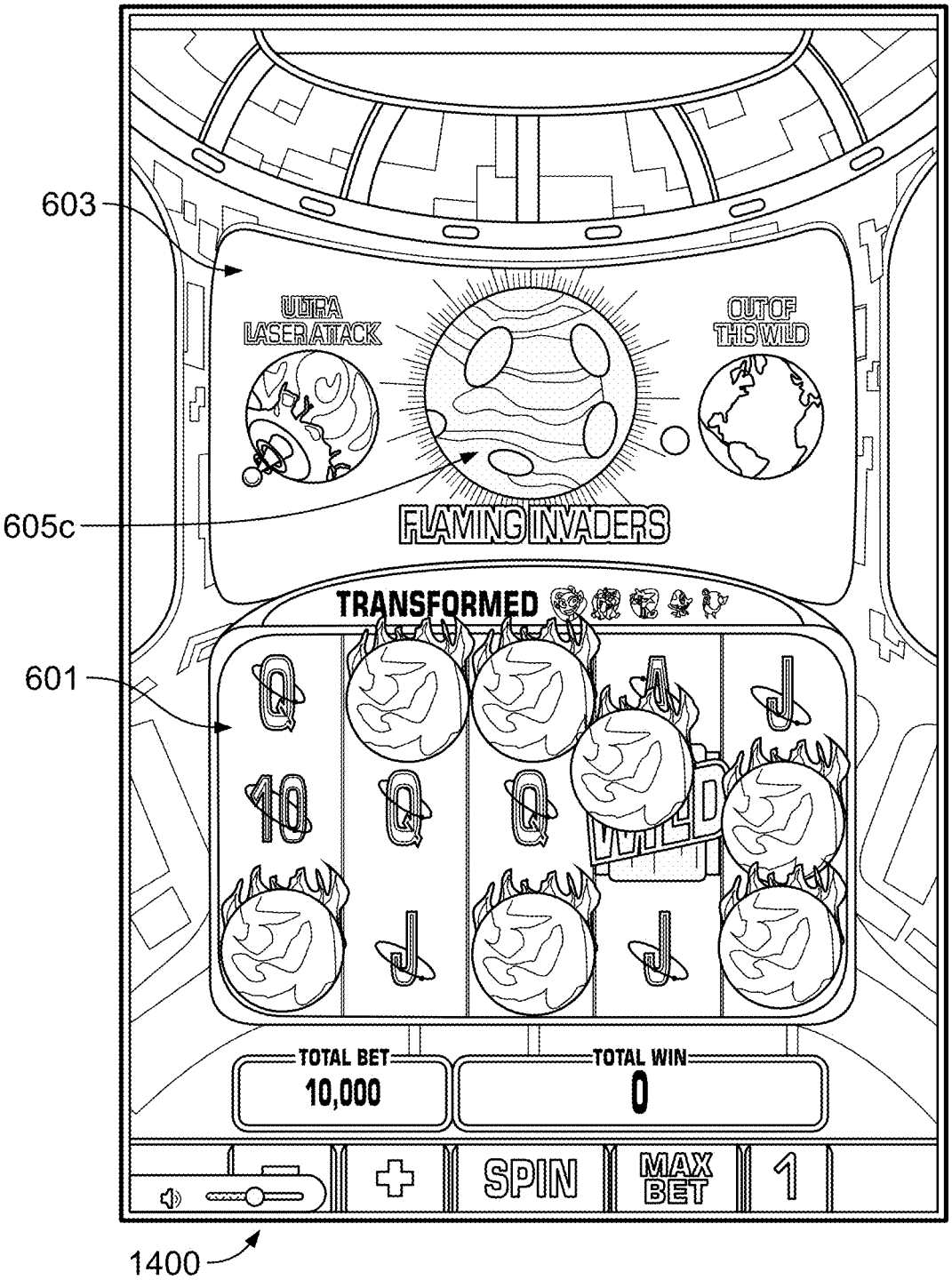
FIG. 14 shows an example of a display that may be presented after that of FIG. 13 according to some implementations.

FIG. 14 shows an example of a display that may be presented after that of FIG. 13 according to some implementations. In this example, the third game feature image 605*c* has returned to its normal size, but the previously-emitted fireballs are shown to be burning, and thereby transforming, all of the picture symbols shown that were previously shown in the first GUI portion 601.

Figure 15:
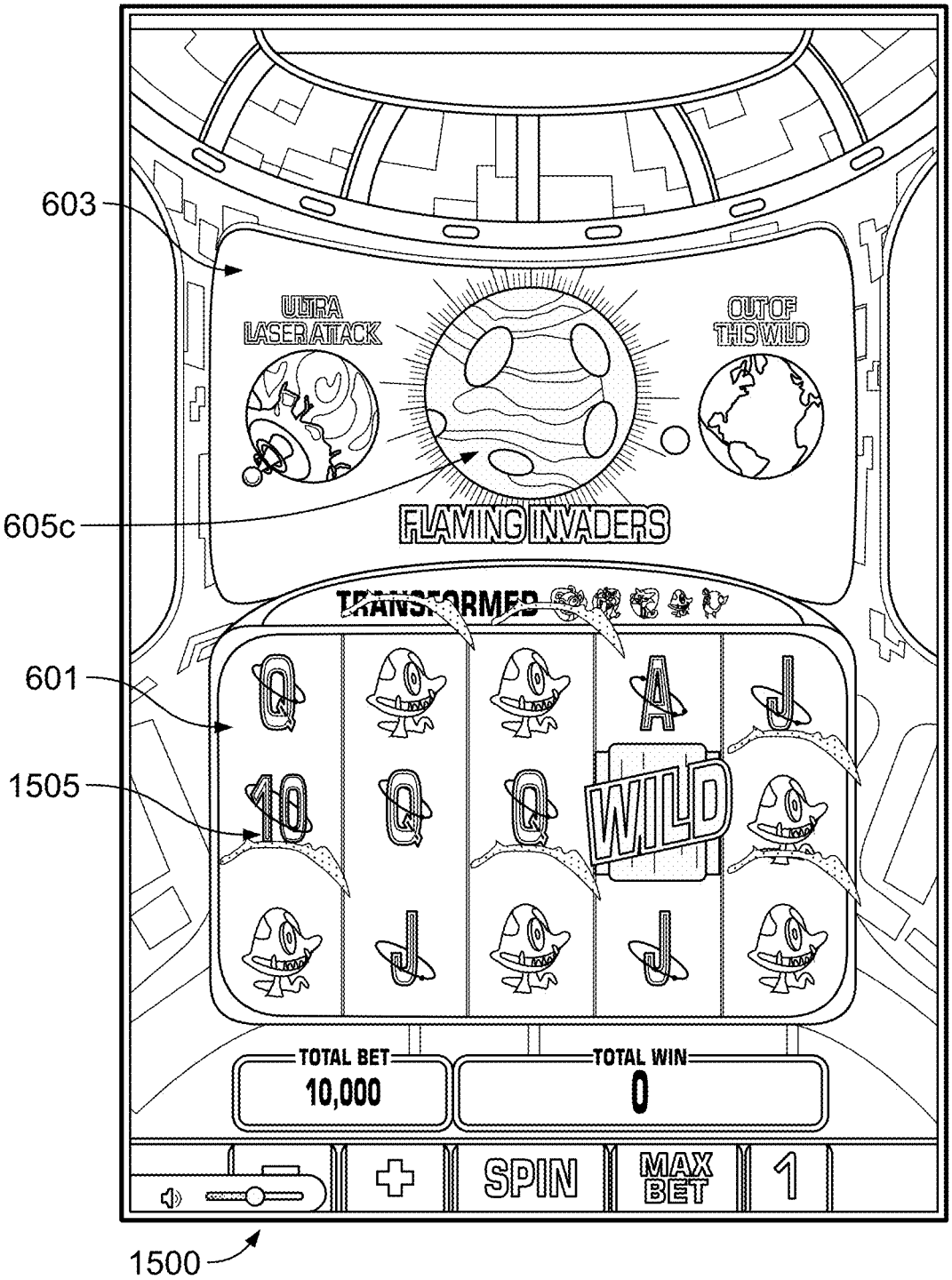
FIG. 15 shows an example of a display that may be presented after that of FIG. 14 according to some implementations.

FIG. 15 shows an example of a display that may be presented after that of FIG. 14 according to some implementations. In this example, all of the picture symbols shown that were previously shown in the first GUI portion 601 have been transformed into a selected one of the picture symbols. Some implementations involve a randomized process of selecting which picture symbol will replace all of the other picture symbols. In the example shown in FIG. 15, at this moment the last remaining picture symbol flames 1505 are dissipating. Now that all of the picture symbols shown that were previously shown in the first GUI portion 601 have been transformed into a selected one of the picture symbols, the probability of a winning combination of picture symbols has increased. In some implementations, this condition may persist during only one game instance after a game feature has been triggered. However, in other implementations this condition may persist during more than one game instance.

Figure 16:
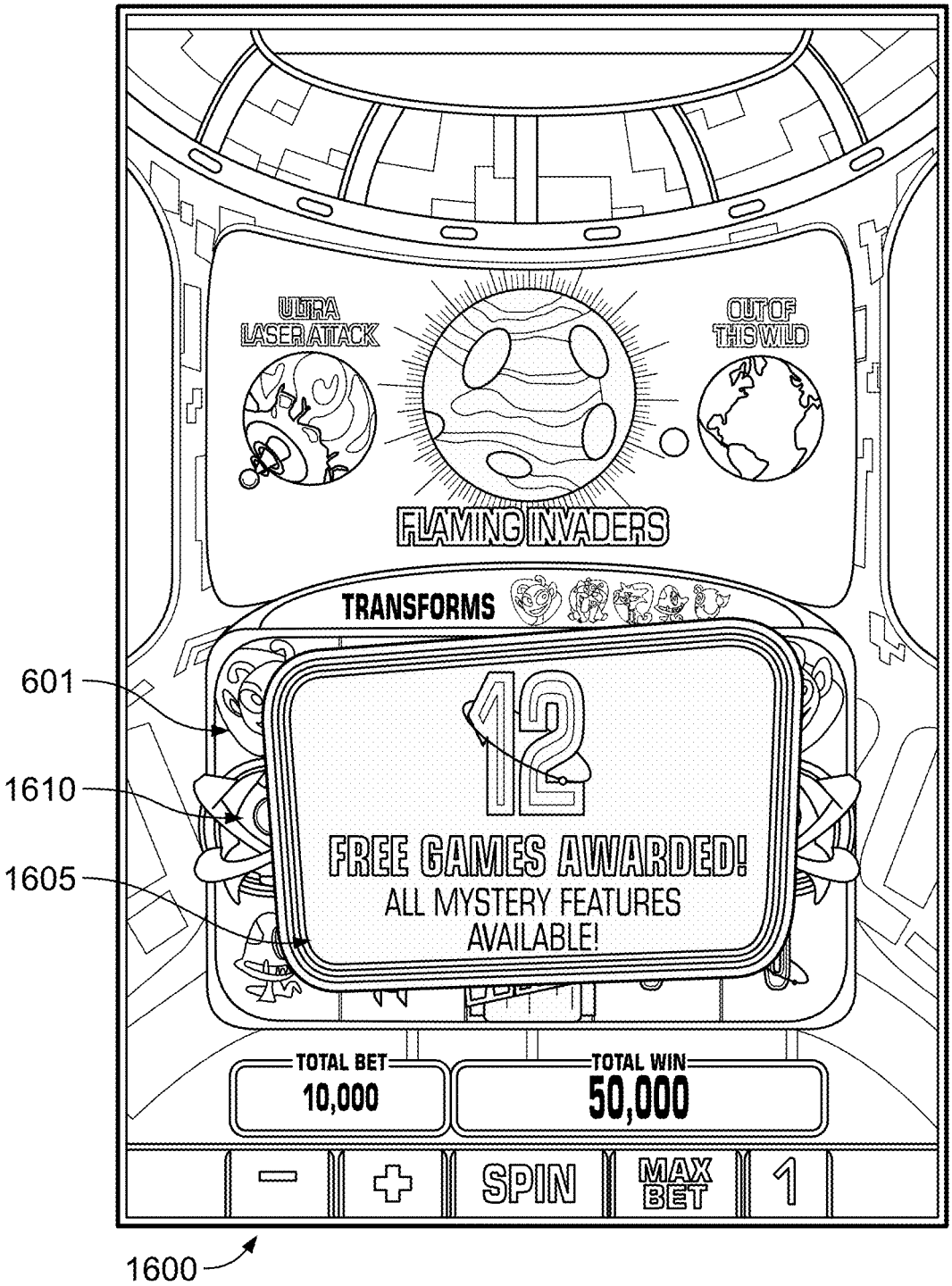
FIG. 16 shows an example of a display that may be presented according to some implementations of the method of FIG. 5.

FIG. 16 shows an example of a display that may be presented according to some implementations of the method of FIG. 5. As with other implementations provided herein, the particular types of elements, the particular numbers of elements and the particular arrangement of elements shown in FIG. 16 are merely examples. In this example, the display 1600 shows an example of an image 1605 that may be presented when free games are awarded, e.g., after a determined number of trigger symbols has been presented during a base game outcome presentation. In some instances, the trigger symbol may be a scatter pay symbol. In this example, the image 1605 is presented in the first GUI portion 601 and indicates that 12 free games have been awarded. In this example, the trigger symbol is a rocket symbol 1610. The determined number of the trigger symbol and/or the corresponding number of free games may, in some instances, vary according to a bet level. For example, a higher bet level may require a lower number of the trigger symbol to be presented during a base game outcome in order to trigger a free game round.

Figure 17:
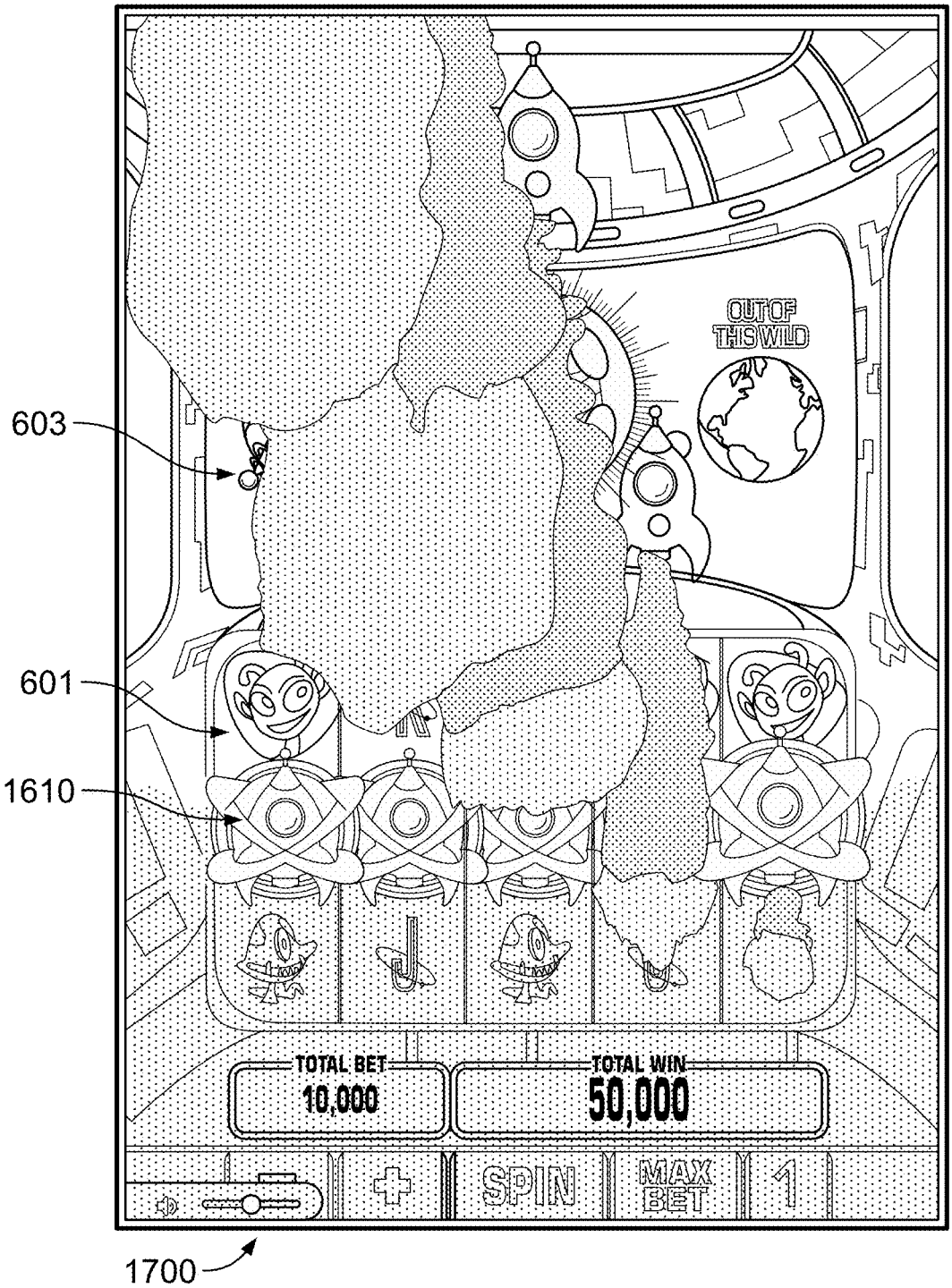
FIG. 17 shows an example of a display that may be presented after that of FIG. 16 according to some implementations.

FIG. 17 shows an example of a display that may be presented after that of FIG. 16 according to some implementations. In this example, the rocket symbols 1610 that triggered the free game round are blasting off from the first GUI portion 601. Some of the rocket symbols 1610 have entered the second GUI portion 603, whereas other rocket symbols 1610 have already passed through the second GUI portion 603 and appear to be continuing upwards.

According to some implementations, game feature selection may be the same during a free game round as during a base game. However, in some examples the game feature selection process and/or one or more of the game features themselves may be different during a free game round. In some such example, a control system may be configured for controlling a display system to present at least one free game feature image in the second GUI portion during a free game round. In some instances, the free game feature will be available for at least the first free game instance of the free game round.

The free game feature image may correspond to a free game feature that is not selectable for a base game. For example, the free game feature may combine features of the first and second game features, may combine features of the first and third game features or may combine features of the second and third game features. According to some such implementations, the free game feature image may be a composite of the first and second game feature images, a composite of the first and third game feature images or a composite of the second and third game feature images. In other examples, the free game feature may be an entirely different game feature, e.g., a game feature that introduces new symbols, such as prize on symbols, etc.

According to some implementations, a game feature may be selected by a player during a free game round, e.g., a game feature may be selectable via input received via an interface system. However, in other implementations, a game feature may be automatically selected by a control system during at least a portion of a free game round. For example, a game feature may be automatically selected by the control system during at least a first free game instance of a free game round.

In some implementations, the probability of a game feature being triggered is higher during a free game instance than during a base game instance. According to some such implementations, a game feature will be triggered during every free game instance.

In some examples, each free game instance of the free game round may involve randomly selecting, via the control system, a game feature, and determining, via the control system, a free game outcome based, at least in part, on the game feature. According to some such examples, each free game instance of the free game round may involve randomly selecting, via the control system, a game feature from the plurality of selectable game features and determining, via the control system, a free game outcome based, at least in part, on the game feature.

Figure 18:
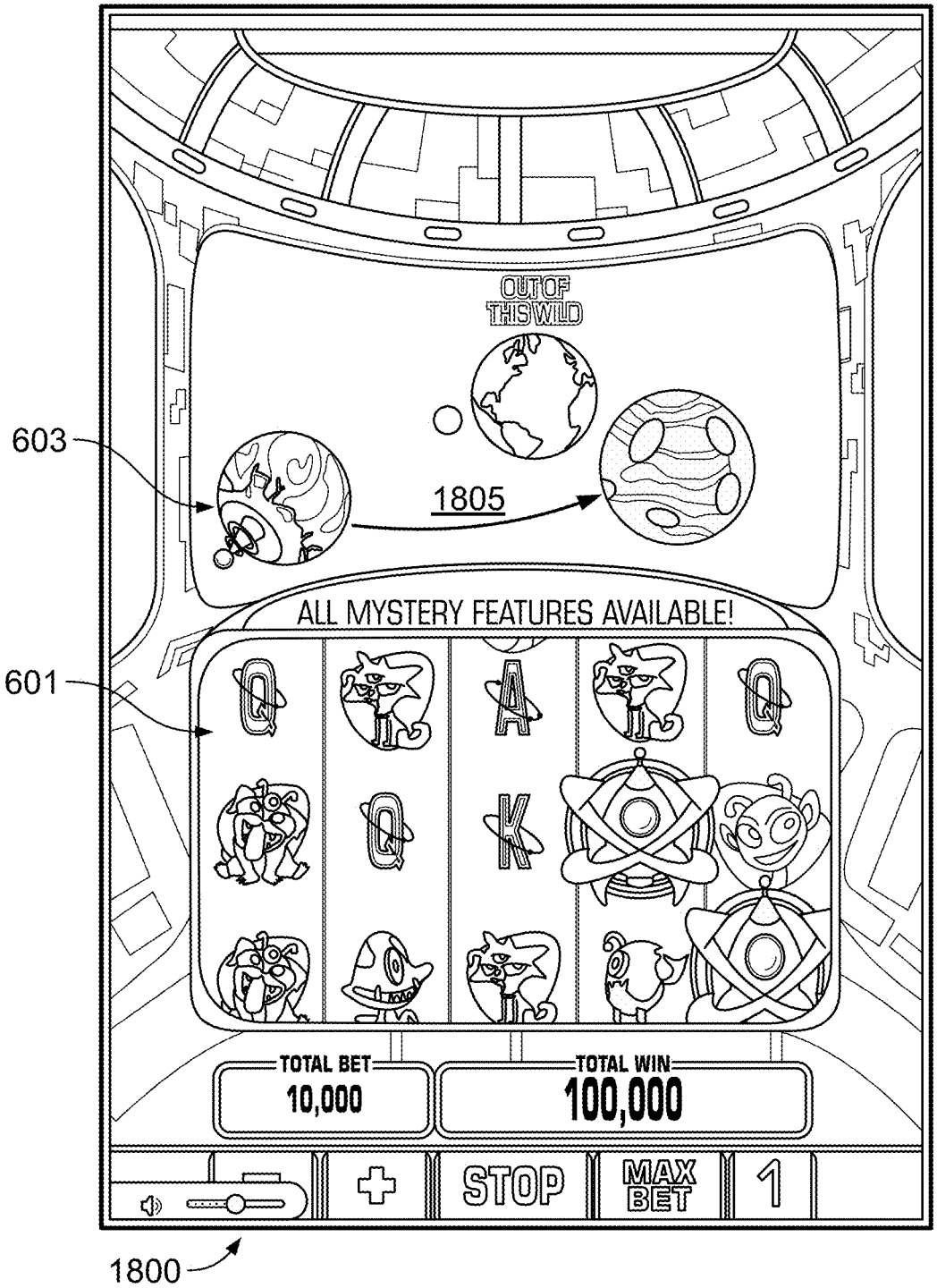
FIG. 18 shows an example of a display that may be used to present a free game according to some implementations.

FIG. 18 shows an example of a display that may be used to present a free game according to some implementations. In this example, each free game instance involves randomly selecting, via the control system, a game feature corresponding to one of the game feature images shown in the second GUI portion 603. According to this implementation, the game feature images are rotated in the direction of the arrow 1805 while the game feature is being randomly selected. The game feature image corresponding to the randomly selected game feature will subsequently be moved to the central area of the second GUI portion 603 and enlarged, as shown and described elsewhere herein.

According to some implementations, randomly selecting the game feature may involve making at least one RNG call and receiving a result of the at least one RNG call. According to some such implementations, randomly selecting the game feature may involve selecting the game feature by applying the result of the at least one RNG call to at least one weighted table corresponding to the plurality of selectable game features. Non-limiting examples of some such weighted tables are shown below:

| FG TF Feature Weighted Table | |
|---|---|
| V1 | 333 |
| V2 | 333 |
| V3 | 334 |
| No Feature | 0 |

| FG TF V1 Feature Mystery Pic Weighted Table | |
|---|---|
| Pic1 | 14 |
| Pic2 | 15 |
| Pic3 | 15 |
| Pic4 | 28 |
| Pic5 | 28 |

| FG TF V3 Feature Mystery Pic Weighted Table | |
|---|---|
| Pic1 | 14 |
| Pic2 | 17 |
| Pic3 | 17 |
| Pic4 | 26 |
| Pic5 | 26 |

FG TF V2 Feature Wild Reel Weighted Table

| R1 | R2 | R3 | R4 | R5 | ID | Weight |
|---|---|---|---|---|---|---|
| 0 | 0 | 0 | 1 | 0 | 00010 | 150 |
| 0 | 0 | 0 | 0 | 1 | 00001 | 200 |
| 0 | 1 | 0 | 0 | 0 | 01000 | 250 |
| 0 | 0 | 1 | 0 | 0 | 00100 | 147 |
| 0 | 1 | 0 | 1 | 0 | 01010 | 1400 |
| 0 | 0 | 0 | 1 | 1 | 00011 | 2000 |
| 0 | 1 | 0 | 0 | 1 | 01001 | 1880 |
| 0 | 0 | 1 | 1 | 0 | 00110 | 1300 |
| 0 | 0 | 1 | 0 | 1 | 00101 | 1800 |
| 0 | 1 | 1 | 0 | 0 | 01100 | 850 |
| 0 | 1 | 0 | 1 | 1 | 01011 | 6 |
| 0 | 1 | 1 | 1 | 0 | 01110 | 4 |
| 0 | 0 | 1 | 1 | 1 | 00111 | 6 |
| 0 | 1 | 1 | 0 | 1 | 01101 | 6 |
| 0 | 1 | 1 | 1 | 1 | 01111 | 1 |

According to this example and as shown in the "FG TF Feature Weighted Table," one of the game features is always triggered during a free game instance and each of the three game features has almost the same probability of being selected. In this example, the "mystery pic" weighted tables for the first and third game features are used to determine which picture symbol will be used to replace the symbols that are removed when either the first or the third game feature is selected in a free game instance. The feature wild reel weighted table is used for determining how many (and which) columns of wild symbols will be presented for free game instances in which the second game feature is selected.

However, other types of weighted tables are within the scope of the present disclosure. In some such examples, at least one weighted table may make a selected game feature more likely to be different from a most recent game feature than to be the most recent game feature. In other words, such weighted tables may be biased towards changing a game feature during a subsequent free game instance rather than retaining the game feature from the most recent free game instance.

While specific examples have been described with respect to the figures, it will be appreciated that many modifications and changes may be made by those skilled in the art without departing from the scope of the present disclosure. For example, although some examples are described as embodiments of base games, the concepts disclosed herein can also be applied to other types of games, such as feature games or bonus games, e.g., free spins of a slot game. Similarly, although some examples are described as embodiments of feature games or bonus games, e.g., free spins of a slot game, the concepts disclosed herein can also be applied to other types of games, such as base games. Any variation and derivation from the above description and figures are included in the scope of the present disclosure as defined by the claims.

The invention claimed is:

1. A gaming device, comprising:

a display system including one or more displays;

an interface system including at least one network interface and at least one user interface; and a control system including one or more processors, the control system being configured for:

controlling the display system to present a graphical user interface (GUI) for presenting a wagering game, the wagering game comprising a slot game, wherein presenting the GUI involves:

presenting a first GUI portion in a first area of the display system, the first GUI portion including display symbols presented at a plurality of display symbol locations, the plurality of display symbol locations being arranged in a plurality of display symbol rows and display symbol columns; and presenting a second GUI portion in a second area of the display system while the first GUI portion is being presented in the first area of the display system, the second GUI portion including a plurality of game feature images, each game feature image of the plurality of game feature images corresponding with one of a plurality of selectable game features;

receiving, via the interface system, first game feature input for selecting a game feature corresponding to one of the game feature images, wherein receiving the first game feature input involves receiving user input for selecting a first game feature;

receiving, via the interface system, first base game initiation input for initiation of a first base game instance of the wagering game; and controlling the display system to present the first base game instance of the wagering game in the first GUI portion while continuing to present the second GUI portion in the second area of the display system, wherein presenting the first base game instance of the wagering game involves:

determining a first base game outcome and corresponding first display symbols for the first base game instance of the wagering game, wherein determining the first base game outcome involves determining whether to remove at least one display symbol from a full set of display symbols that is potentially available for selection during the instance of the wagering game and wherein determining whether to remove the at least one display symbol comprises:

making at least one random number generator (RNG) call;

receiving a result of the at least one RNG call; and determining whether to remove at least one display symbol by applying the result of the at least one RNG call to at least one weighted table corresponding to the first game feature; and controlling the display system to display the first base game outcome in the first GUI portion.

2. The gaming device of claim 1, wherein the full set of display symbols includes lower-value display symbols and higher-value display symbols and wherein the at least one display symbol is a lower-value display symbol.

3. The gaming device of claim 1, wherein the full set of display symbols includes lower-value display symbols and higher-value display symbols and wherein determining whether to remove the at least one display symbol comprises determining whether to remove all of the lower-value display symbols.

4. The gaming device of claim 1, wherein receiving the first game feature input involves receiving user input for selecting a second game feature and wherein determining the first base game outcome involves determining whether to present wild symbols in at least an entire display symbol row or at least an entire display symbol column.

5. The gaming device of claim 4, wherein determining the first base game outcome involves determining whether to present wild symbols in one entire display symbol column, two entire display symbol columns, three entire display symbol columns or four entire display symbol columns.

6. The gaming device of claim 1, wherein receiving the first game feature input involves receiving user input for selecting a third game feature and wherein determining the first base game outcome involves determining whether to:

remove all instances of at least a first display symbol from a full set of display symbols that is potentially available for selection during the instance of the wagering game; and substitute a second display symbol for all instances of at least the first display symbol.

7. The gaming device of claim 6, wherein determining the first base game outcome involves determining whether to remove all instances of all picture-type display symbols from the full set of display symbols.

8. The gaming device of claim 6, wherein determining the first base game outcome involves:

making at least a first random number generator (RNG) call and a second RNG call;

receiving a first result of the first RNG call and a second result of the second RNG call;

determining, by applying the first result to a first weighted table corresponding to the third game feature, that all instances of at least the first display symbol will be removed from the full set of display symbols; and determining, by applying the second result to a second weighted table corresponding to the third game feature, the second display symbol.

9. The gaming device of claim 1, wherein determining the first base game outcome involves determining that the first base game outcome will trigger a free game round and wherein each free game instance of the free game round comprises:

randomly selecting, via the control system, a game feature from the plurality of selectable game features; and determining, via the control system, a free game outcome based, at least in part, on the game feature.

10. The gaming device of claim 9, wherein randomly selecting the game feature involves:

making at least one random number generator (RNG) call;

receiving a result of the at least one RNG call; and selecting the game feature by applying the result of the at least one RNG call to at least one weighted table corresponding to the plurality of selectable game features.

11. The gaming device of claim 10, wherein the at least one weighted table makes a selected game feature more likely to be different from a most recent game feature than to be the most recent game feature.

12. The gaming device of claim 1, wherein determining the first base game outcome involves determining that the first base game outcome will trigger a free game round and wherein the control system is further configured for controlling the display system to present at least one free game feature image in the second GUI portion, the free game feature image corresponding to a free game feature that is not selectable for a base game, the free game feature being available for at least a first free game instance of the free game round.

13. The gaming device of claim 12, wherein the free game feature is selectable via input received via the interface system.

14. The gaming device of claim 12, wherein each free game instance of the free game round comprises:

randomly selecting, via the control system, a game feature; and determining, via the control system, a free game outcome based, at least in part, on the game feature.

15. The gaming device of claim 12, wherein the control system is further configured to automatically select the free game feature for at least the first free game instance.

16. The gaming device of claim 1, wherein the control system is further configured for:

receiving, via the interface system, second game feature input for selecting a game feature corresponding to one of the game feature images presented in the second GUI portion;

receiving, via the interface system, second base game initiation input for initiation of a second base game instance of the wagering game; and presenting the second base game instance of the wagering game in the first GUI portion while continuing to present the second GUI portion in the second area of the display system.

17. The gaming device of claim 1, wherein the control system is further configured for controlling the display system to move a game feature image corresponding to a selected game feature to a central portion of the second area of the display system.

18. A gaming device, comprising:

a display system including one or more displays;

an interface system including at least one network interface and at least one user interface; and a control system including one or more processors, the control system being configured for:

controlling the display system to present a graphical user interface (GUI) for presenting a wagering game, the wagering game comprising a slot game, wherein presenting the GUI involves:

presenting a first GUI portion in a first area of the display system, the first GUI portion including display symbols presented at a plurality of display symbol locations, the plurality of display symbol locations being arranged in a plurality of display symbol rows and display symbol columns; and presenting a second GUI portion in a second area of the display system while the first GUI portion is being presented in the first area of the display system, the second GUI portion including a plurality of game feature images, each game feature image of the plurality of game feature images corresponding with one of a plurality of selectable game features;

receiving, via the interface system, first game feature input for selecting a game feature corresponding to one of the game feature images, wherein receiving the first game feature input involves receiving user input for selecting a second game feature;

receiving, via the interface system, first base game initiation input for initiation of a first base game instance of the wagering game; and controlling the display system to present the first base game instance of the wagering game in the first GUI portion while continuing to present the second GUI portion in the second area of the display system, wherein presenting the first base game instance of the wagering game involves:

determining a first base game outcome and corresponding first display symbols for the first base game instance of the wagering game; and controlling the display system to display the first base game outcome in the first GUI portion, and wherein determining the first base game outcome involves:

making at least one random number generator (RNG) call;

receiving a result of the at least one RNG call; and determining whether to present wild symbols in at least an entire display symbol row or at least an entire display symbol column by applying the result of the at least one RNG call to at least one weighted table corresponding to the second game feature.

19. The gaming device of claim 18, wherein determining the first base game outcome involves determining whether to present wild symbols in one entire display symbol column, two entire display symbol columns, three entire display symbol columns or four entire display symbol columns.

20. A gaming device, comprising:

a display system including one or more displays;

an interface system including at least one network interface and at least one user interface; and a control system including one or more processors, the control system being configured for:

controlling the display system to present a graphical user interface (GUI) for presenting a wagering game, the wagering game comprising a slot game, wherein presenting the GUI involves:

presenting a first GUI portion in a first area of the display system, the first GUI portion including display symbols presented at a plurality of display symbol locations, the plurality of display symbol locations being arranged in a plurality of display symbol rows and display symbol columns; and presenting a second GUI portion in a second area of the display system while the first GUI portion is being presented in the first area of the display system, the second GUI portion including a plurality of game feature images, each game feature image of the plurality of game feature images corresponding with one of a plurality of selectable game features;

receiving, via the interface system, first game feature input for selecting a game feature corresponding to one of the game feature images, wherein receiving the first game feature input involves receiving user input for selecting a third game feature;

receiving, via the interface system, first base game initiation input for initiation of a first base game instance of the wagering game; and controlling the display system to present the first base game instance of the wagering game in the first GUI portion while continuing to present the second GUI portion in the second area of the display system, wherein presenting the first base game instance of the wagering game involves:

determining a first base game outcome and corresponding first display symbols for the first base game instance of the wagering game, wherein determining the first base game outcome involves determining whether to:

remove all instances of at least a first display symbol from a full set of display symbols that is potentially available for selection during the instance of the wagering game; and substitute a second display symbol for all instances of at least the first display symbol; and controlling the display system to display the first base game outcome in the first GUI portion.

21. The gaming device of claim 20, wherein determining the first base game outcome involves determining whether to remove all instances of all picture-type display symbols from the full set of display symbols.

22. A gaming device, comprising:

a display system including one or more displays;

an interface system including at least one network interface and at least one user interface; and a control system including one or more processors, the control system being configured for:

controlling the display system to present a graphical user interface (GUI) for presenting a wagering game, the wagering game comprising a slot game, wherein presenting the GUI involves:

presenting a first GUI portion in a first area of the display system, the first GUI portion including display symbols presented at a plurality of display symbol locations, the plurality of display symbol locations being arranged in a plurality of display symbol rows and display symbol columns; and presenting a second GUI portion in a second area of the display system while the first GUI portion is being presented in the first area of the display system, the second GUI portion including a plurality of game feature images, each game feature image of the plurality of game feature images corresponding with one of a plurality of selectable game features;

receiving, via the interface system, first game feature input for selecting a game feature corresponding to one of the game feature images;

receiving, via the interface system, first base game initiation input for initiation of a first base game instance of the wagering game; and controlling the display system to present the first base game instance of the wagering game in the first GUI portion while continuing to present the second GUI portion in the second area of the display system, wherein presenting the first base game instance of the wagering game involves:

determining a first base game outcome and corresponding first display symbols for the first base game instance of the wagering game, wherein determining the first base game outcome involves determining that the first base game outcome will trigger a free game round and wherein each free game instance of the free game round comprises:

randomly selecting, via the control system, a game feature from the plurality of selectable game features, wherein randomly selecting the game feature involves:

making at least one random number generator (RNG) call;

receiving a result of the at least one RNG call; and selecting the game feature by applying the result of the at least one RNG call to at least one weighted table corresponding to the plurality of selectable game features; and determining, via the control system, a free game outcome based, at least in part, on the game feature; and controlling the display system to display the first base game outcome in the first GUI portion.

23. A gaming device, comprising:

a display system including one or more displays;

an interface system including at least one network interface and at least one user interface; and a control system including one or more processors, the control system being configured for:

controlling the display system to present a graphical user interface (GUI) for presenting a wagering game, the wagering game comprising a slot game, wherein presenting the GUI involves:

presenting a first GUI portion in a first area of the display system, the first GUI portion including display symbols presented at a plurality of display symbol locations, the plurality of display symbol locations being arranged in a plurality of display symbol rows and display symbol columns; and presenting a second GUI portion in a second area of the display system while the first GUI portion is being presented in the first area of the display system, the second GUI portion including a plurality of game feature images, each game feature image of the plurality of game feature images corresponding with one of a plurality of selectable game features;

receiving, via the interface system, first game feature input for selecting a game feature corresponding to one of the game feature images;

receiving, via the interface system, first base game initiation input for initiation of a first base game instance of the wagering game; and controlling the display system to present the first base game instance of the wagering game in the first GUI portion while continuing to present the second GUI portion in the second area of the display system, wherein presenting the first base game instance of the wagering game involves:

determining a first base game outcome and corresponding first display symbols for the first base game instance of the wagering game, wherein determining the first base game outcome involves determining that the first base game outcome will trigger a free game round and wherein the control system is further configured for controlling the display system to present at least one free game feature image in the second GUI portion, the free game feature image corresponding to a free game feature that is not selectable for a base game, the free game feature being available for at least a first free game instance of the free game round, the free game feature being selectable via input received via the interface system; and controlling the display system to display the first base game outcome in the first GUI portion.

* * * * *